US009676199B2

(12) United States Patent
Hayashi

(10) Patent No.: US 9,676,199 B2
(45) Date of Patent: Jun. 13, 2017

(54) TANK SYSTEM

(71) Applicant: BROTHER KOGYO KABUSHIKI KAISHA, Nagoya-shi, Aichi-ken (JP)

(72) Inventor: Masahiro Hayashi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/082,551

(22) Filed: Mar. 28, 2016

(65) Prior Publication Data

US 2017/0087858 A1 Mar. 30, 2017

(30) Foreign Application Priority Data

Sep. 30, 2015 (JP) ..... 2015-193586

(51) Int. Cl.
*B41J 2/175* (2006.01)

(52) U.S. Cl.
CPC ..... *B41J 2/17523* (2013.01); *B41J 2/17553* (2013.01)

(58) Field of Classification Search
CPC ..... B41J 2/17523; B41J 2/17553
See application file for complete search history.

(56) References Cited

U.S. PATENT DOCUMENTS 3,280,828 A * 10/1966 Stiel ..... B43K 13/00 134/117
6,273,151 B1 * 8/2001 Kong ..... B41J 2/17506 141/18
2002/0063759 A1 * 5/2002 Hirano ..... B41J 2/17503 347/85
2004/0182459 A1 * 9/2004 Klein ..... E03C 1/04 137/801
2006/0192821 A1 * 8/2006 Koga ..... B41J 2/17509 347/85
2007/0024683 A1 * 2/2007 Yan ..... B41J 2/17506 347/86

FOREIGN PATENT DOCUMENTS

JP 2013-176968 A 9/2013

* cited by examiner

*Primary Examiner* — Stephen Meier
*Assistant Examiner* — Alexander D Shenderov
(74) *Attorney, Agent, or Firm* — Merchant & Gould P.C.

(57) ABSTRACT

There is provided a tank system including a tank and a liquid injection container. The tank has a liquid storage chamber; and a cylindrical wall extending from an outer wall in a first direction. The tank is formed with inlet and outlet ports each communicating the liquid storage chamber with the outside of the tank. The liquid injection container includes: a liquid storing portion; a liquid discharging portion; an arm; and a craw. The cylindrical wall has: a first portion, a second portion located between the first portion and the outer wall and having outer diameter smaller than that of the first portion, and a connecting surface connecting the outer circumferential surface of the first portion to that of the second portion. The craw contacts the connecting surface of the cylindrical wall toward the first direction in a state that the liquid discharging portion is inserted into the inlet port.

15 Claims, 19 Drawing Sheets

TANK SYSTEM

CROSS REFERENCE TO RELATED APPLICATION

The present application claims priority from Japanese Patent Application No. 2015-193586 filed on Sep. 30, 2015, the disclosure of which is incorporated herein by reference in its entirety.

BACKGROUND

Technical Field

The present teaching relates to a tank system including a tank and a liquid injection container wherein a liquid in the liquid injection container is allowed to flow into a liquid storage chamber of the tank.

Description of the Related Art

Conventionally, there is known a liquid consuming apparatus which is provided with a liquid consuming section configured to consume a liquid stored in a liquid storage chamber. For example, there is known an ink-jet printer provided with an ink receiving portion, and a liquid jetting (discharging) head configured to jet (discharge) an ink supplied from an ink bottle installed in the ink receiving portion.

The above-described ink bottle is provided with a lid member. The ink bottle and the lid member are provided with openings, respectively. The lid member is rotatably attached to the ink bottle. The lid member closes the opening of the ink bottle in a state that the lid member is rotated to a rotational position at which the opening of the ink bottle and the opening of the lid member are not matched, and releases the opening of the ink bottle in a state that the lid member is rotated to another rotational position at which the opening of the ink bottle is matched with the opening of the lid member. The ink bottle and the lid member are provided with projections for positioning, respectively. In a state that the positions of the respective projections are matched, the opening of the ink bottle is closed.

The ink receiving portion is provided with a recessed portion to which the projection of each of the ink bottle and the lid member is fittable. When an ink is to be supplied to the ink receiving portion, a user fits the projections of the ink bottle and the lid member into the recessed portion of the ink receiving portion to thereby install the ink bottle in the ink receiving portion, and user rotates the ink bottle. With this, only the ink bottle is rotated while the lid member is fixed, and the opening of the ink bottle is matched with the opening of the lid member. This allows the ink to flow from the ink bottle to the ink receiving portion. In this state, the projection of the ink bottle is inserted into the ink receiving portion, thereby suppressing such a situation that the ink bottle is easily detached or easily comes off from the ink receiving portion. When the ink bottle is to be attached to or detached from the ink receiving portion, it is necessary that the position of the projection of the ink bottle is matched with the position of the projection of the lid member. When the position of the projection of the ink bottle is matched with the position of the projection of the lid member, the opening of the ink bottle is thereby closed or clogged by the lid member, which in turn suppresses any outflow of the ink from the ink bottle to the outside of the ink receiving portion.

Although the above-described ink bottle is installable in the ink receiving portion and capable of suppressing any outflow of the ink from the ink bottle to the outside of the ink receiving portion, the construction of the ink bottle is relatively complex.

The present teaching has been made in view of the above-described situations, and an object of the present teaching is to provide a system for (tank system including) a tank and a liquid injection container allowing the liquid injection container to be fixed to the tank when liquid such as ink is to be supplied to the tank and capable of suppressing any outflow of the ink to the outside of the tank, with a simple construction.

SUMMARY

According to an aspect of the present teaching, there is provided a tank system including:

a tank including:

a liquid storage chamber configured to store liquid therein;

an outer wall having an inner surface facing the liquid storage chamber and an outer surface facing outside of the tank;

a cylindrical wall having a cylindrical shape and extending from the outer wall in a first direction;

the tank being formed with an inlet port penetrating through the outer wall and the cylindrical wall in the first direction, and communicating the liquid storage chamber with the outside of the tank; and an outlet port penetrating through the outer wall and communicating the liquid storage chamber with the outside of the tank;

a liquid injection container including:

a liquid storing portion configured to store the liquid therein;

a liquid discharging portion extending in a second direction, having a liquid discharge passage formed therein, and configured to communicate the liquid storing portion and the liquid storage chamber via the liquid discharging passage in a state that the liquid discharging portion is inserted into the inlet port;

an arm extending from an outer surface of the liquid discharging portion in a direction including a component in the second direction; and a craw extending, from an end portion in the second direction of the arm, in a direction approaching toward the liquid discharging portion, wherein the cylindrical wall includes: a first portion, a second portion located between the first portion and the outer wall and having an outer diameter smaller than that of the first portion, and a connecting surface connecting an outer circumferential surface of the first portion and an outer circumferential surface of the second portion; and the craw is configured to contact the connecting surface of the cylindrical wall in the first direction in the state that the liquid discharging portion is inserted into the inlet port.

According to the above-described configuration, the user supplies the liquid such as an ink to the tank in the state that the liquid discharging portion of the liquid injection container is inserted into the inlet port of the tank. In this state, the craw of the arm (namely, at least one craw) contacts the connecting surface of the cylindrical wall of the tank toward the first direction. With this, the liquid injection container is easily fixed to the tank, and it is possible to suppress any disengaging or separation of the liquid injection container with respect to the tank while the ink is being supplied to the tank or is to be supplied to the tank.

According to the present teaching, the liquid injection container can be easily fixed to the tank when the liquid such as an ink is supplied to the tank, and it is possible to suppress any detachment of the liquid injection container from the tank, thereby suppressing any outflow of the ink to the outside of the tank.

BRIEF DESCRIPTION OF THE DRAWINGS

FIGS. 1A and 1B are external perspective views each depicting an example of a multifunction peripheral 10 according to an embodiment of the present teaching, wherein FIG. 1A depicts a state that a cover 70 is closed, and FIG. 1B depicts a state that the cover 70 is opened.

FIGS. 6A and 6B are cross-sectional views each depicting a cap 113, an inner lid 161 and an inlet port 112, wherein FIG. 6A is a view depicting a state before the cap 113 and the inner lid 161 are installed in the inlet port 112, and FIG. 6B is a view depicting a state that the cap 113 and the inner lid 161 are installed in the inlet port 112.

FIGS. 7A to 7C are views each depicting the shape of the inner lid 161, wherein FIG. 7A is a plane view, FIG. 7B is a front cross-sectional view, and FIG. 7C is a bottom view of the inner lid 161.

FIGS. 8A to 8C are views each depicting the shape of the cap 113, wherein FIG. 8A is a plane view, FIG. 8B is a front cross-sectional view, and FIG. 8C is a bottom view of the cap 113.

FIGS. 9A and 9B are cross-sectional views each depicting an ink injection container 181, the inner lid 161 and the inlet port 112, wherein FIG. 9A is a view depicting a state before the ink injection container 181 is installed in the inlet port 112, and FIG. 9B is a view depicting a state that the ink injection container 181 is installed in the inlet port 112.

FIGS. 14A and 14B are cross-sectional views each depicting an ink injection container 214, an inner lid 161 and an inlet port 112 in a third modification, wherein FIG. 14A is a view depicting a state before the ink injection container 214 is installed in the inlet port 112, and FIG. 14B is a view depicting a state that the ink injection container 214 is installed in the inlet port 112.

FIGS. 17A and 17B are cross-sectional views each depicting an ink injection container 241, an inner lid 161 and an inlet port 112 in a second embodiment, wherein FIG. 17A is a view depicting a state before the ink injection container 241 is installed in the inlet port 112, and FIG. 17B is a view depicting a state that the ink injection container 241 is installed in the inlet port 112.

DESCRIPTION OF THE EMBODIMENTS

Figure 1A:
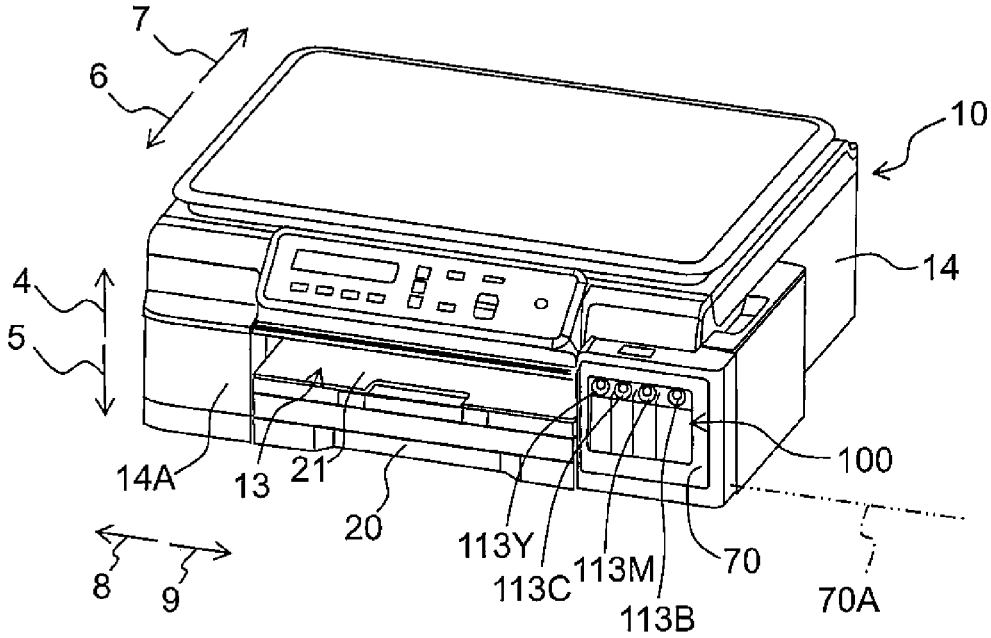

An embodiment of the present teaching will be described below. Note that, however, the embodiment described below is merely an example of the present teaching; it goes without saying that it is possible to make any appropriate change(s) in the embodiment of the present teaching without departing from the gist and/or scope of the present teaching. Further, an up direction 4 and a down direction 5 are defined with a state that a multi-function peripheral 10 is usably installed or a posture in which the multi-function peripheral 10 is usably installed as the reference. Note that a state depicted in FIGS. 1A and 1B and that the multi-function peripheral 10 is usably installed will be referred to as a "usable state"; and that a posture depicted in FIGS. 1A and 1B and in which the multi-function peripheral 10 is usably installed will be referred to as a "usable posture". Further, a front direction 6 and a rear direction 7 are defined such that a side on which an opening 13 of the multi-function peripheral 10 is provided is designated as the frontward side (front surface or front side), and a left direction 8 and a right direction 9 are defined as viewing the multi-function peripheral 10 from the frontward side (front surface). Furthermore, in the embodiment, the up direction 4 and the down direction 5 (up and down directions 4 and 5) correspond to the vertical direction, and each of the front direction 6 and the rear direction 7 (front and rear directions 6 and 7), and the left direction 8 and the right direction 9 (left and right directions 8 and 9) corresponds to the horizontal direction.

<Overall Configuration of Multi-Function Peripheral 10>

Figure 1B:
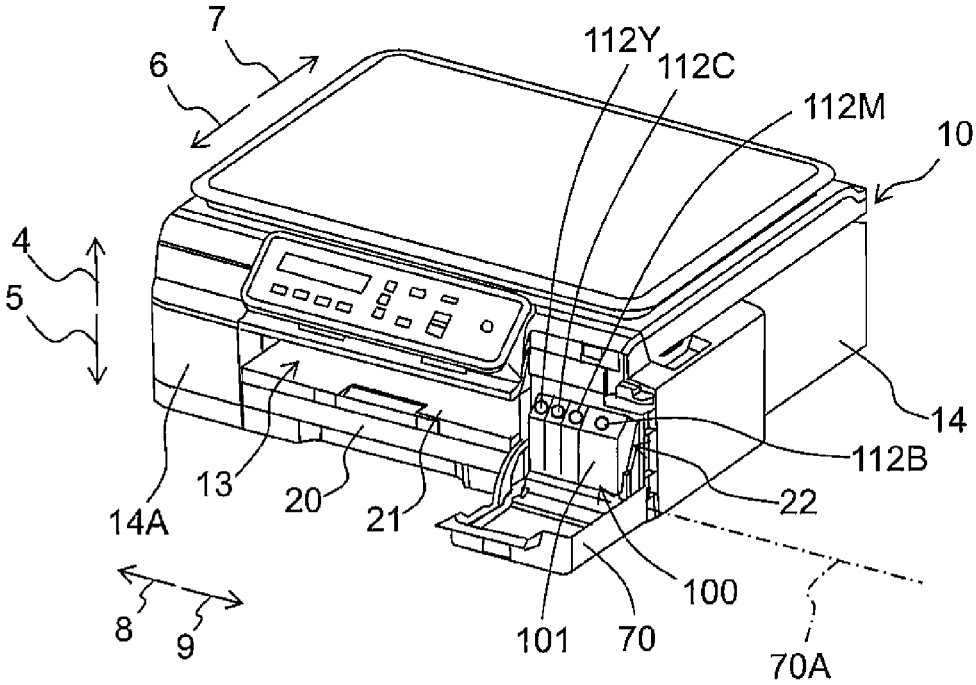
Figure 2:
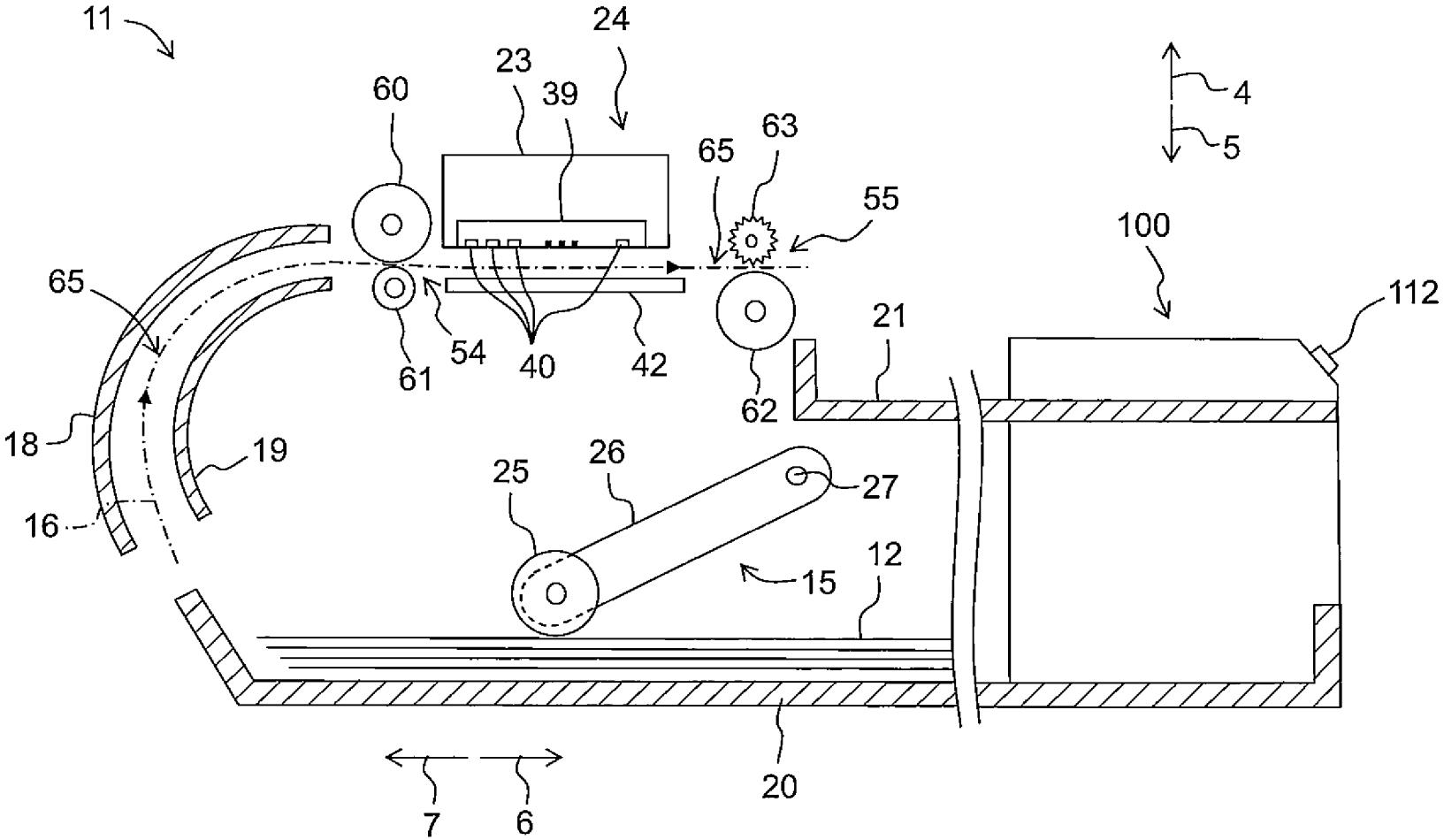
FIG. 2 is a vertical cross-sectional view schematically depicting the internal structure of a printer unit 11.

As depicted in FIGS. 1A and 1B, the multi-function peripheral 10 is formed to have a substantially rectangular parallelepiped shape. The multi-function peripheral 10 includes, at a lower portion of the multi-function peripheral 10, a printer unit 11 which records an image onto a paper 12 (see FIG. 2) by an ink-jet recording method. As depicted in FIG. 2, the printer unit 11 includes a feeding section 15, a feeding tray 20, a discharge tray 21, a conveyance roller section 54, a recording section 24, a discharge roller section 55, a platen 42, and an ink tank 100 (an example of a tank). Further, the multi-function peripheral 10 has various functions such as a facsimile function and a print function, etc.

<Feeding Tray 20, Discharge Tray 21>

As depicted in FIGS. 1A and 1B, the feeding tray 20 is inserted into or removed from the multi-function peripheral 10 by a user, in the front and rear directions 6 and 7 through the opening 13. The opening 13 is formed in a central portion in the left and right directions 8 and 9 of the front surface of the multi-function peripheral 10. The feeding tray 20 is capable of supporting a plurality of sheets of the paper 12 that are stacked in the feeding tray 20. The discharge tray 21 is arranged at a position at the upper side of the feeding tray 20, and is inserted or removed together with the feeding tray 20. The discharge tray 21 supports the paper 12 discharged through a space between the recording section 24 and the platen 42 by the discharge roller section 55.

<Feeding Section 15>

The feeding section 15 feeds the paper 12 supported by the feeding tray 20 to a conveyance route 65 (to be described later on). As depicted in FIG. 2, the feeding section 15 includes a feeding roller 25, a feeding arm 26, and a shaft 27. The feeding roller 25 is rotatably supported by the feeding arm 26 at a front end thereof. The feeding roller 25 rotates in a direction for causing the paper 12 to be conveyed in a conveyance direction 16 when a conveyance motor (not depicted in the drawings) is reversely rotated. In the following description, the rotations of the feeding roller 25, a conveyance roller 60 (to be described later on), and a discharge roller 62 (to be described later on) in the direction for causing the paper 12 to be conveyed in the conveyance direction 16 are each referred to as "normal rotation". The feeding arm 26 is pivotably supported by the shaft 27 supported by a frame of the printer unit 11. A bias is applied to the feeding arm 26 by an elastic force of a spring or by the self-weight of the feeding arm 26 such that the feeding arm 26 is pivoted and urged toward the feeding tray 20.

<Conveyance Route 65>

Figure 3:
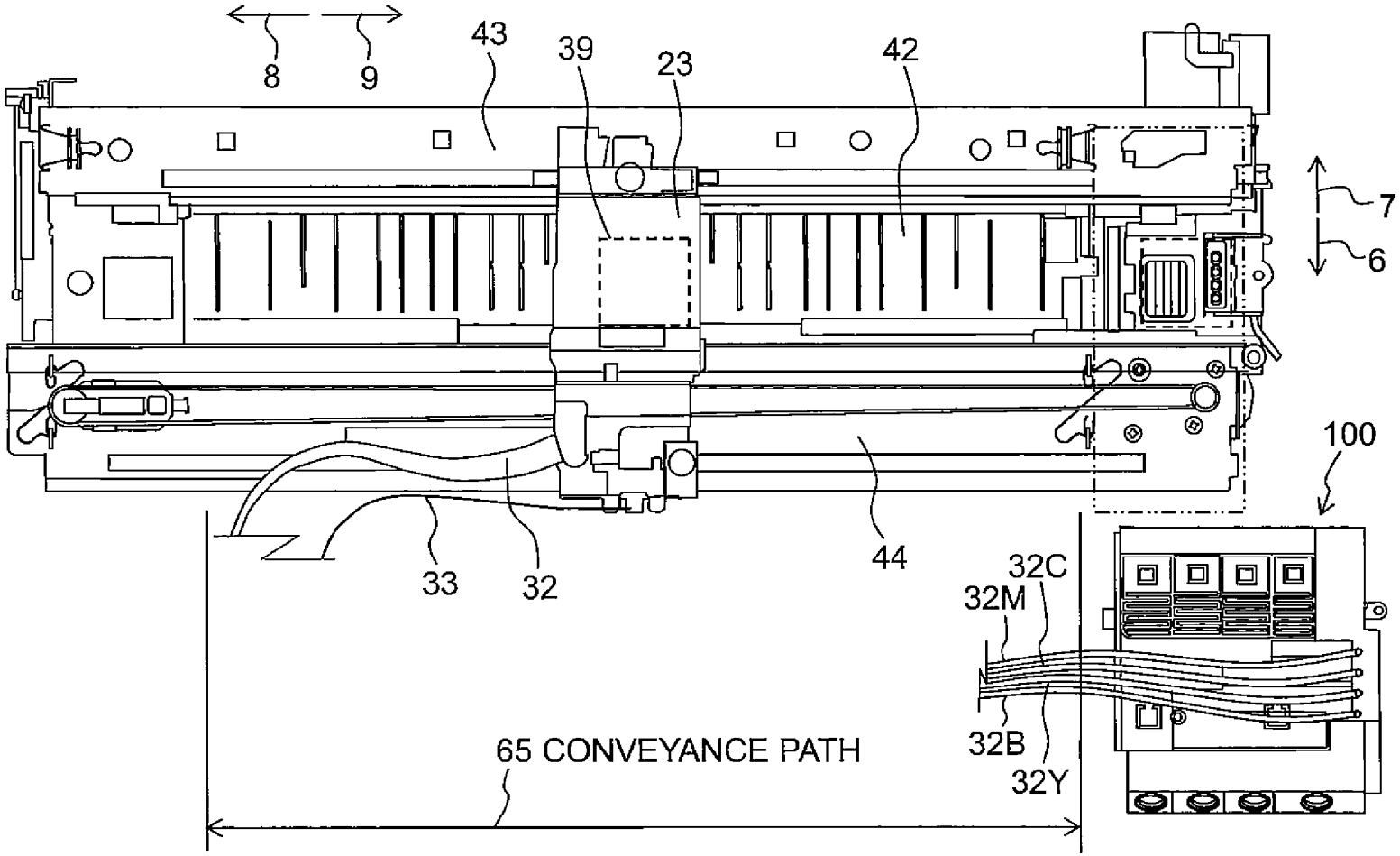
FIG. 3 is a plane view depicting the arrangement of a carriage 23 and an ink tank 100.

As depicted in FIG. 2, in the interior of the printer unit 11, a space is defined by an outer guide member 18 and an inner guide member 19 which are arranged to face with each other with a predetermined interval or a gap intervened therebetween. This space constructs a portion of a conveyance route 65. The conveyance route 65 is a route or passage that is extended from a rear-end portion of the feeding tray 20 toward the rear side of the printer unit 11. Further, the conveyance route 65 makes a U-turn while being extended from the lower side to the upper side, at the rear side of the printer unit 11; and then the conveyance route 65 reaches the discharge tray 21 via a space between the recording section 24 and the platen 42. As depicted in FIGS. 2 and 3, a portion of the conveyance route 65 between the conveyance roller section 54 and the discharge roller section 55 is provided at a substantially central portion in the left and right directions 8 and 9 of the multi-function peripheral 10, and is extended in the front and rear directions 6 and 7. Note that in FIG. 2, the conveyance direction 16 of the paper 12 in the conveyance route 65 is indicated by an arrow of a dashed-dotted line.

<Conveyance Roller Section 54>

As depicted in FIG. 2, the conveyance roller section 54 is arranged at the upstream side of the recording section 24 in the conveyance direction 16. The conveyance roller section 54 includes a conveyance roller 60 and a pinch roller 61 which are facing each other. The conveyance roller 60 is driven by a conveyance motor. The pinch roller 61 rotates following the rotation of the conveyance roller 60. The paper 12 is conveyed in the conveyance direction 16 by being pinched between the conveyance roller 60 and the pinch roller 61 which are rotated positively by the normal rotation of the conveyance motor.

<Discharge Roller Section 55>

As depicted in FIG. 2, the discharge roller section 55 is arranged at the downstream side of the recording section 24 in the conveyance direction 16. The discharge roller section 55 includes a discharge roller 62 and a spur 63 which are facing each other. The discharge roller 62 is driven by the conveyance motor. The spur 63 rotates following the rotation of the discharge roller 62. The paper 12 is conveyed in the conveyance direction 16 by being pinched between the discharge roller 62 and the spur 63 which are rotated positively by the normal rotation of the conveyance motor.

<Recording Section 24>

As depicted in FIG. 2, the recording section 24 is arranged between the conveyance roller section 54 and the discharge roller section 55 in the conveyance direction 16. Further, the platen 42 and the recording section 24 are arranged to face each other in the up and down directions 4 and 5, while sandwiching the conveyance route 65 therebetween. Namely, the recording section 24 is arranged at a position at which the recording section 24 is located above the conveyance route 65 in the up direction 4 and at which the recording section 24 faces the conveyance route 65. The recording section 24 includes a carriage 23 and a recording head 39.

As depicted in FIG. 3, the carriage 23 is supported by guide rails 43 and 44 which are extended respectively in the left and right directions 8 and 9, at positions separated respectively in the front and rear directions 6 and 7. The guide rails 43 and 44 are supported by the frame of the printer unit 11. The carriage 23 is connected to a known belt mechanism disposed on the guide rail 44. The belt mechanism is driven by a carriage motor (not depicted in the drawings). The carriage 23 connected to the belt mechanism reciprocates in the left and right directions 8 and 9 by being driven by the carriage motor.

Further, an ink tube 32 which connects the ink tank 100 and the recording head 39 and a flexible flat cable 33 which electrically connects the recording head 39 and a control circuit board having a controller (not depicted in the drawings) mounted thereon are extended from the carriage 23. The ink tube 32 supplies an ink stored in the ink tank 100 to the recording head 39. More specifically, four ink tubes 32B, 32M, 32C, and 32Y via which inks of four colors (which are, for example, black, magenta, cyan, and yellow colors) are distributed are extended from the ink tank 100, and are connected to the carriage 23 in a bundled form. The flexible flat cable 33 transmits a control signal output from the controller to the recording head 39. Note that in the following description, the four ink tubes 32B, 32M, 32C and 32Y are collectively referred to as "ink tube(s) 32" in some cases. Further, reference numerals having different alphabetic suffixes (B, M, C, and Y) are assigned to four components provided while corresponding to the colors of inks, respectively; in a case that these components are collectively referred to, then these components are assigned with a reference numeral(s) while omitting the respective alphabetic suffixes, in some cases.

As depicted in FIG. 2, the recording head 39 is installed on the carriage 23. A plurality of nozzles 40 is formed in the lower surface of the recording head 39. End portions (forward end or tip portions) of the nozzles 40 are exposed from the lower surface of the recording head 39 and from the lower surface of the carriage 23 on which the recording head 39 is installed. In the following description, the surface through which the end portions of the nozzles 40 are exposed will be referred to as a "nozzle surface" in some cases. The recording head 39 jets or discharges the ink as fine ink droplets (minute ink droplets) through the nozzles 40. In a process of movement of the carriage 23, the recording head 39 jets the ink droplets toward the paper 12 supported by the platen 42. Accordingly, an image, etc. is recorded on the paper 12. The nozzles 40 are an example of a liquid discharging (jetting) section.

<Platen 42>

As depicted in FIGS. 2 and 3, the platen 42 is arranged between the conveyance roller section 54 and the discharge roller section 55 in the conveyance direction 16. The platen 42 is arranged so as to face the recording section 24 in the up and down directions 4 and 5, and supports the paper 12, conveyed by the conveyance roller section 54, from therebelow.

<Ink Tank 100>

As depicted in FIGS. 1A and 1B, the ink tank 100 is accommodated inside a casing 14 of the multi-function peripheral 10. The ink tank 100 is fixed to the multi-function peripheral 10 such that the ink tank 100 cannot be easily removed from the multi-function peripheral 10.

The front surface of the ink tank 100 is exposed to the outside of the multi-function peripheral 10 via an opening 22 formed in a front wall 14A of the casing 14. The opening 22 is adjacent to the opening 13 in the left and right directions 8 and 9. Further, the casing 14 is provided with a cover 70 pivotable (rotatable) between a closed position at which the cover 70 covers the opening 22 (see FIG. 1A), and an opened position at which the cover 70 is opened to thereby allow the opening 22 to be exposed to the outside of the multi-function peripheral 10 and at which the cover 70 does not cover the opening 22 (see FIG. 1B). The cover 70 is supported by the casing 14 to be pivotable about a rotational axis 70A extended in the left and right directions 8 and 9 at a lower end portion in the down direction 5 of the casing 14.

Figure 4:
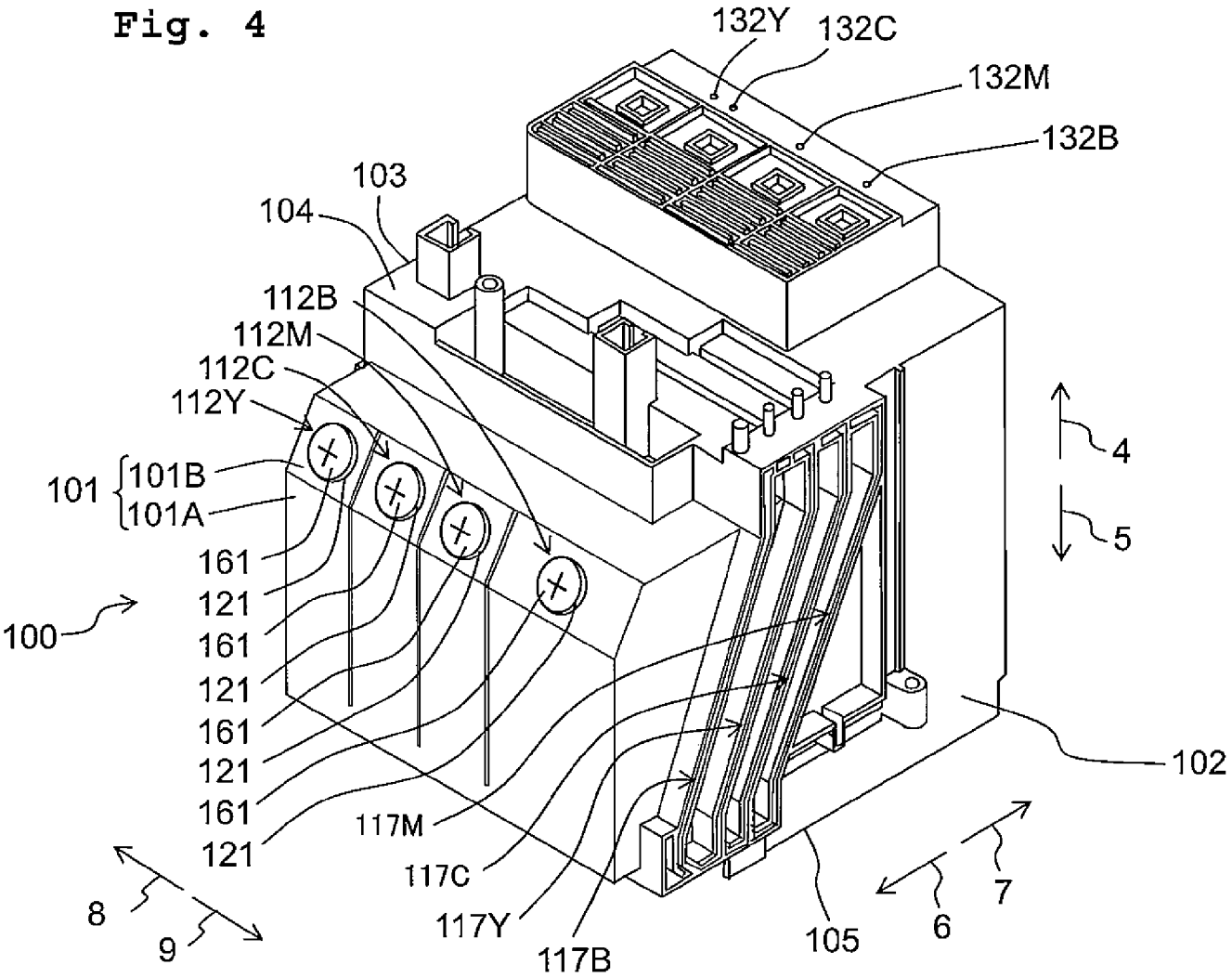
FIG. 4 is a front perspective view of the ink tank 100.
Figure 5:
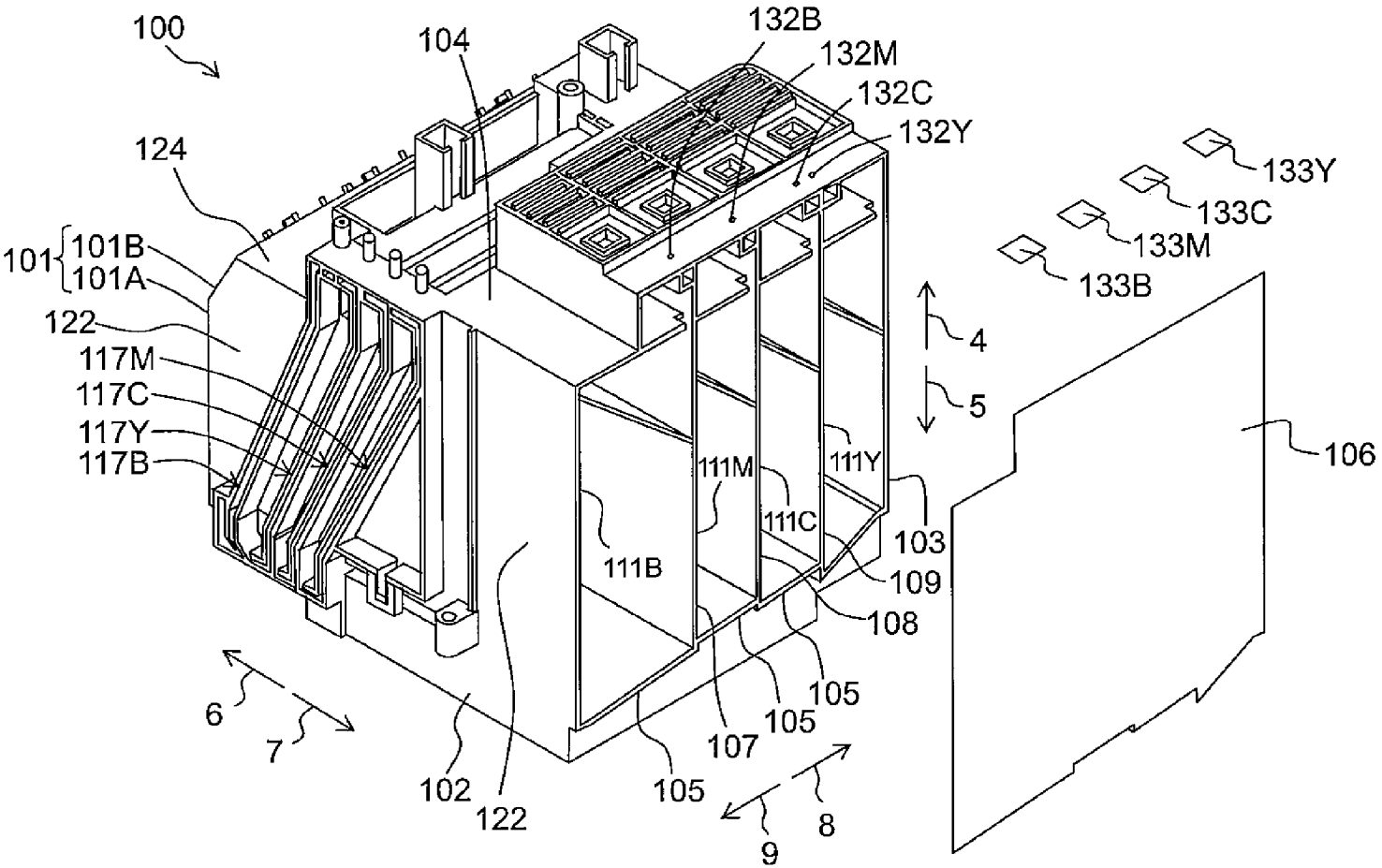
FIG. 5 is a rear perspective view of the ink tank 100.

As depicted in FIGS. 4 and 5, the ink tank 100 has an outer shape that is substantially rectangular parallelepiped. The ink tank 100 has a front wall 101, a right wall 102, a left wall 103, an upper wall 104, and a lower wall 105. The front wall 101 is constructed of a standing wall 101A extending from the lower wall 105 substantially in the up and down directions 4 and 5 and an inclined wall 101B which is connected or continued to the upper end of the standing wall 101A and which is inclined relative to the up and down directions 4 and 5 and the front and rear directions 6 and 7. Further, the upper surface, of the lower wall 101B constructing the bottom surface of an ink chamber 111 (to be described later on) is inclined downward and rightward. On the other hand, the rear surface of the ink tank 100 is opened or uncovered. Further, by fixing a film 106 by welding to rear-end surfaces of the right wall 102, the left wall 103, the upper wall 104 and the lower wall 105, the rear surface of the ink tank 100 is sealed. Namely, the film 106 forms the rear wall of the ink tank 100.

<Ink Chamber 111>

As depicted in FIG. 5, a plurality of partition walls 107, 108 and 109 which define or demarcate the internal space of the ink tank 100 is provided in the interior of the ink tank 100. Each of the partition walls 107, 108 and 109 is extended in the up and down directions 4 and 5 and the front and rear directions 6 and 7, and is connected to the front wall 101, the upper wall 104, the lower wall 105 and the film 106. Further, the partition walls 107, 108 and 109 are disposed to be separated and away from one another in the left and right directions 8 and 9. As a result, the internal space of the ink tank 100 is partitioned into four ink chambers 111B, 111M, 111C and 111Y that are adjacent in the left and right directions 8 and 9. The ink chambers 111 (111B, 111M, 111C and 111Y) are each an example of a liquid storage chamber for storing ink to be jetted through the nozzles 40.

The ink chamber 111B is a space demarcated by the front wall 101, the right wall 102, the upper wall 104, the lower wall 105, the film 106 and the partition wall 107. The ink chamber 111M is a space demarcated by the front wall 101, the upper wall 104, the lower wall 105, the film 106 and the partition walls 107 and 108. The ink chamber 111C is a space demarcated by the front wall 101, the upper wall 104, the lower wall 105, the film 106 and the partition walls 108 and 109. The ink chamber 111Y is a space demarcated by the front wall 101, the left wall 103, the upper wall 104, the lower wall 105, the film 106 and the partition wall 109.

In the following description, the ink chambers 111B, 111M, 111C, and 111Y are collectively referred to as "ink chamber(s) 111" in some cases.

Inks of different four colors are stored in the ink chambers 111, respectively. Specifically, black ink is stored in the ink chamber 111B, cyan ink is stored in the ink chamber 111C, magenta ink is stored in the ink chamber 111M, and yellow ink is stored in the ink chamber 111Y. Each of the color inks is an example of a liquid. However, the number of ink chambers 111 and the colors of the inks are not limited by or restricted to the number and the colors in the above-described example. The ink chambers 111 are arranged along the left-right directions 8 and 9. Further, among the four ink chambers 111B, 111M, 111C and 111Y, the ink chamber 111B is arranged at the rightmost side and the ink chamber 111Y is arranged at the leftmost side. Furthermore, the ink chamber 111B has a volume larger than the any other ink chambers 111M, 111C and 111Y.

<Inlet Port 112>

The inclined wall 101B of the ink tank 100 is provided with inlet ports 112B, 112M, 112C, and 112Y via which the inks are allowed to flow into the ink chambers 111, respectively. In the following, the inlet ports 112B, 112M, 112C and 112Y are collectively referred to as "inlet port(s) 112" in some cases. The inclined wall 101B is an example of an outer wall. The inclined wall 101B has an inner surface 101C facing the ink chamber 111, and an outer surface 101D facing the outside of the ink tank 100. The inclined wall 101B is provided with a cylindrical wall 121 having a cylindrical shape and extending toward the outside of the ink tank 100 in a direction orthogonal to the inclined wall 101B. The detail of the cylindrical wall 121 will be described later on. The inlet port 112 penetrates through the inclined wall 101B in a direction of the thickness of the inclined wall 101B, passes through the inside of the cylindrical wall 121, and makes the corresponding ink chamber 111 communicate with the outside of the ink tank 100.

The inlet port 112 provided on the inclined wall 101B and the cylindrical wall 121 is exposed to the outside of the multi-function peripheral 10, via the opening 22, when the cover 70 is positioned at the opened position as depicted in FIG. 1B. In the present embodiment, the posture of the ink tank 100 when the ink can be poured into the ink chamber 111 through the inlet port 112 (pouring posture, refilling posture) coincides with the posture of the ink tank 100 when the multi-function peripheral 10 is in the usable posture. Namely, when the multi-function peripheral 10 is in the usable posture, the ink is poured or refilled into the ink chamber 111 through the inlet port 112. Although the inlet 112 is circular-shaped in this embodiment, the shape of the inlet 112 is not limited to this; the inlet 112 may have an elliptical shape, a polygonal shape, etc.

The ink tank 100 has caps 113B, 113M, 113C and 113Y that are detachable and attachable with respect to the inlet ports 112, respectively. In the following, the caps 113B, 113M, 113C and 113Y are collectively referred to as "cap(s) 113" in some cases. As depicted in FIG. 1A, the cap 113 attached to the inlet port 112 blocks or closes the inlet port 112 by making a tight contact with the periphery of the inlet port 112. On the other hand, as depicted in FIG. 1B, in a case that the cap 113 is removed from the inlet port 112, the inlet port 112 is open or released. The cap 113 is attached to and removed or detached from the inlet port 112 in a state that the cover 70 is located at the opened position. Further, by removing the cap 113 from the inlet port 112, the ink can be poured or refilled into the ink chamber 111 via the inlet port 112. The detail of the cap 113 will be described later on.

<Ink Outflow Channel and Atmosphere Communicating Hole>

As depicted in FIGS. 4 and 5, ink outflow channels 117B, 117M, 117C and 117Y are connected to the ink chambers 111B, 111M, 113C and 113Y, respectively. Each of the ink outflow channels 117B, 117M, 117C and 117Y is a channel that allows the ink stored in the corresponding ink chamber 111 to flow out of the ink tank 100. The ink outflow channels 117B, 117M, 117C and 117Y are formed in the ink tank 100.

An end of each of the ink outflow channels 117B, 117M, 117C and 117Y is connected to the ink chamber 111 corresponding thereto; the other end of each of the ink outflow channels 117B, 117M, 117C and 117Y is connected to the ink tube 32 corresponding thereto. With this, the ink stored in each of the ink chambers 111 is supplied to the recording head 39 via one of ink outflow channels 117B, 117M, 117C and 117Y and one of the ink tubes 32 which correspond to the ink chamber 111. A portion of each of the ink outflow channels 117B, 117M, 117C and 117Y is formed by covering a groove, formed in the right wall 102, with a non-illustrated film. In the following, the ink outflow channels 117B, 117M, 117C and 117Y are collectively referred to as "ink outflow channel(s) 117" in some cases. The ink outflow channel(s) 117 is/are an example of an outlet port.

Further, the ink chambers 111B, 111M, 111C and 111Y are provided with atmosphere communicating holes 132B, 132M, 132C and 132Y, respectively. Each of the atmosphere communicating holes 132B, 132M, 132C and 132Y allows the ink chamber 111 corresponding thereto to communicate with the atmosphere. With this, the internal pressure in each of the ink chambers 111 is maintained at the atmospheric pressure. As a result, it is possible to suppress any excessive supply of the ink due to the increase in internal pressure in the ink chamber 111, or any backflow of the ink due to the decrease in internal pressure in the ink chamber 111, etc. Further, the atmosphere communicating holes 132B, 132M, 132C and 132Y are provided with semipermeable membranes 133B, 133M, 133C and 133Y, respectively, which are adhered thereto and configured to prevent any leakage of the ink. A portion of each of the channels starting from the ink chambers 111B, 111M, 111C and 111Y and reaching the atmosphere communicating holes 132B, 132M, 132C and 132Y is formed by covering a groove formed in the upper wall 104 with a non-illustrated film. In the following, the atmosphere communicating holes 132B, 132M, 132C and 132Y are collectively referred to as "atmosphere communicating hole(s) 132" in some cases. The atmosphere communicating hole(s) 132 is/are an example of the atmosphere communicating portion. Further, the semipermeable membranes 133B, 133M, 133C and 133Y are collectively referred to as "semipermeable membrane(s) 133" in some cases.

<Cylindrical Wall 121>

Figure 6A:
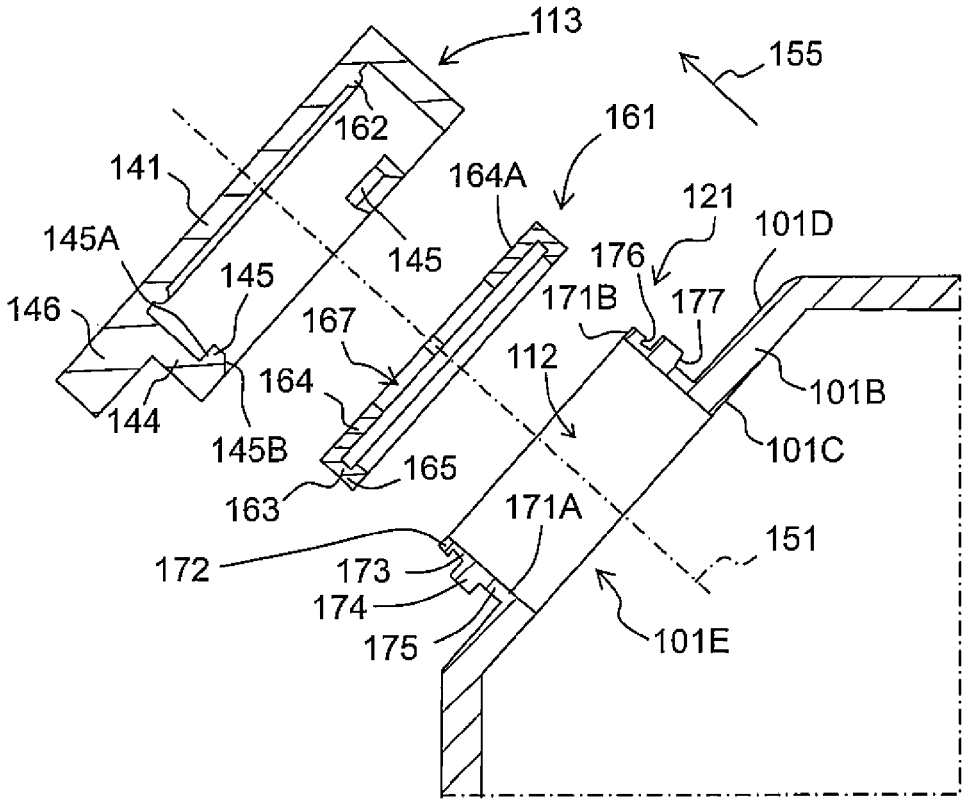

Each of the inlet ports 112 are provided with a cylindrical wall 121, as depicted in FIG. 6A.

The cylindrical wall 121 has a substantially cylindrical shape of which center is a central axis line 151. The cylindrical wall 121 extends from the periphery of an opening 101E provided on the inclined wall 101B of the ink tank 100 in a direction 155 orthogonal to the inclined wall 101B and oriented toward the outside of the ink tank 100 (hereinafter referred to as a "first direction 155"). Namely, the central axis line 151 extends along the first direction 155. The first direction 155 is a direction crossing or intersecting the up direction 4, the down direction 5, the front direction 6 and the rear direction 7; and the first direction 155 has a component in the front direction 6 and a component in the up direction 4. Further, in the following description of an inner lid 161 (to be described later on) and the cap 113, the relationship between the respective directions and the central axis line 151, and the inner lid 161 the cap 113 in a state that the inner lid 161 and the cap 113 are installed in the cylindrical wall 121. Note that the opening 101E is a portion of the inlet port 112.

The cylindrical wall 121 is composed of an end portion 172, an inner lid-engaging portion 173, a first portion 174 and a second portion 175. Each of the end portion 172, the inner lid-engaging portion 173, the first portion 174, and the second portion 175 has a cylindrical shape. The end portion 172, the inner lid-engaging portion 173, the first portion 174 and the second portion 175 are integrally formed in a state that the second portion 175, the first portion 174, the inner lid-engaging portion 173 and the end portion 172 are stacked in this order on the peripheral edge portion, of the inclined surface 101, defining the opening 101E, from the side closer to the inclined wall 101, with the central axes of the cylindrical shapes of the end portion 172, the inner lid-engaging portion 173, the first portion 174 and the second portion 175 being made to be coincident or matched with each other. A line passing through the central axes of the end portion 172, the inner lid-engaging portion 173, the first portion 174 and the second portion 175 is the central axis line 151. The inner circumferential surfaces of the end portion 172, the inner lid-engaging portion 173, the first portion 174 and the second portion 175 and the opening 101E are (define) an inner circumferential surface 171A defining the inlet port 121A. The inner circumferential surfaces of the end portion 172, of the inner lid-engaging portion 173, of the first portion 174, of the second portion 175 and of the opening 101E have a same inner diameter, and are located on one virtual cylindrical surface. The central axis line 151 of the cylindrical wall 121 is also the central axis line 151 of the inlet port 112.

The outer diameter of the inner lid-engaging portion 173 is smaller than the outer diameter of the end portion 172. The outer diameter of the first portion 174 is greater than the outer diameter of the end portion 172 and the outer diameter of the inner lid-engaging portion 173. The outer diameter of the second portion 175 is smaller than the outer diameter of the first portion 174. The outer circumferential surface of the end portion 172 and the outer circumferential surface of the inner lid-engaging portion 173 are connected by a first connecting surface 176. The first connecting surface 176 is expanded along a plane orthogonal to the central axis line 151. The outer circumferential surface of the first portion 174 and the outer circumferential surface of the second portion 175 are connected by a second connecting surface 177. The second connecting surface 177 is expanded along a plane orthogonal to the central axis line 151. Thus, a concavity or dent portion recessed toward the central axis line 151 is formed between the outer circumferential surface of the end portion 172 and the outer circumferential surface of the first portion 174. A concavity or dent portion recessed toward the central axis line 151 is formed between the outer circumferential surface of the first portion 174 and the inclined wall 101B.

<Inner Lid 161>

The ink tank 100 is provided with an inner lid 161 as depicted in FIGS. 6A and 6B and FIGS. 7A to 7C. The inner lid 161 is an example of an elastic portion.

Figure 7A:
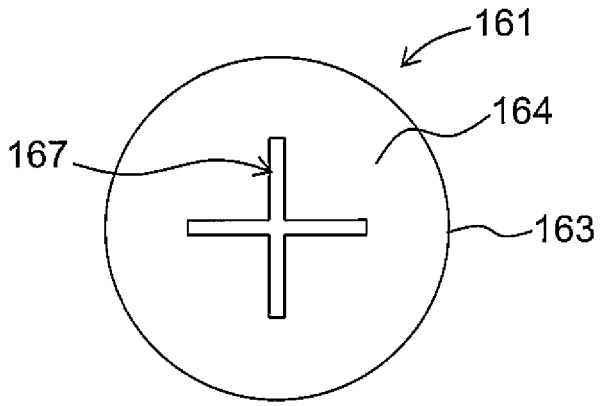
Figure 7B:
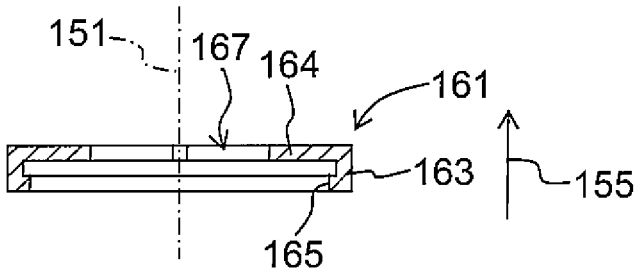
Figure 7C:
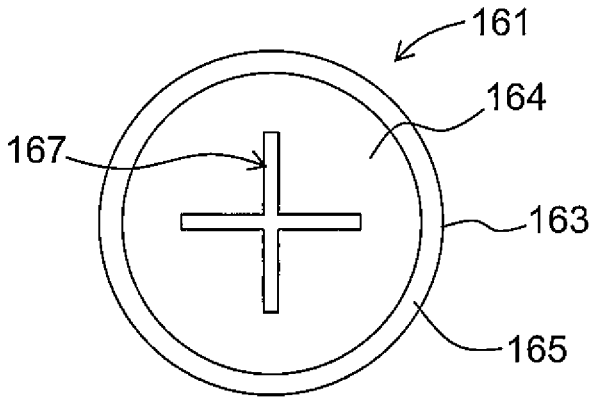

As depicted in FIGS. 7A to 7C, the inner lid 161 is provided with a peripheral portion 163, an extending portion 164 and a projecting portion 165. The inner lid 161 is formed of an elastic material such as a rubber, elastomer, etc., having a low modulus of elasticity. Since the inner lid 161 is formed of the elastic material having the low modulus of elasticity, the inner lid 161 is thus easily deformed in response to insertion of a spout 183 into the inlet port 112 when the ink is supplied to the ink tank 100 by using an ink injection container 181, and is resorted to have the original shape after being deformed in response to removal of the spout 183 from the inlet port 112, as will be described later on.

The peripheral portion 163 has a cylindrical shape with the central axis line 151 as the center thereof. The inner diameter of the peripheral portion 163 is substantially same as the outer diameter of the end portion 172 of the cylindrical wall 121. The outer diameter of the peripheral portion 163 is substantially same as the outer diameter of the first portion 174 of the cylindrical wall 121.

The extending portion 164 is extended, along a plane orthogonal to the central axis line 151, from an end edge portion, of the peripheral portion 163, facing the first direction 155, toward the central axis line 151. The extending portion 164 is formed with a cross-shaped cutout portion 167 of which point of intersection is the central axis line 151. In the cutout portion 167, a virtual cylindrical surface defined by end portions of the cross shape in the cutout portion 167, namely by positions farthest from the central axis line 151 has a diameter greater than the outer diameter of an insertion portion 167 of the spout 183 which will be described later on.

The projecting portion 165 is projecting toward the central axis line 151 from an end edge portion, of the peripheral portion 163, facing the direction opposite to the first direction 155. The inner diameter of the projecting portion 165 is substantially same as the outer diameter of the inner lid-engaging portion 173 of the cylindrical wall 121.

<Cap 113>

Figure 6B:
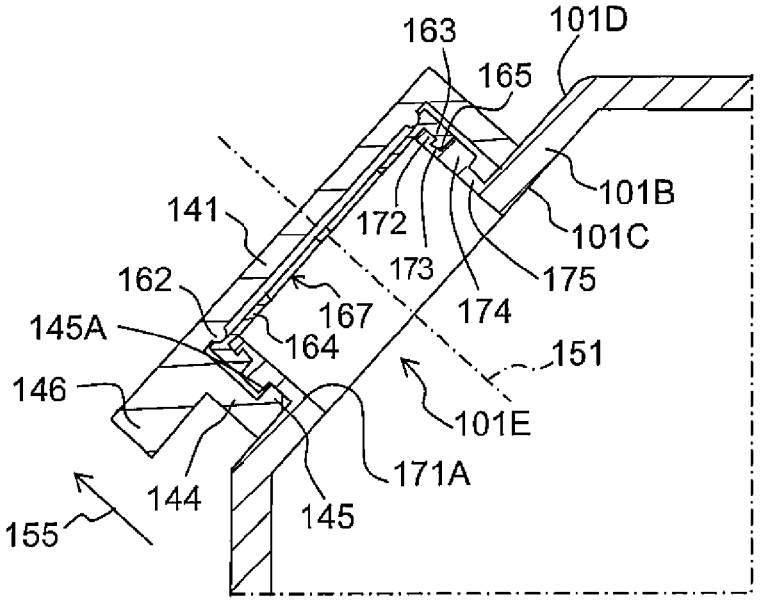

The cap(s) 113 depicted in FIGS. 6A and 6B and FIGS. 8A to 8C is/are attachable and detachable (removable) with respect to the inlet port 112 of the ink tank 100. The cap 113 is movable to an open state wherein the cap 113 is not attached to the inlet port 112 and thus allows the inlet port 112 to be released (opened) as depicted in FIG. 6A, and to a close (clog) state wherein the cap 113 closes the inlet port 112 as depicted in FIG. 6B. In the embodiment, the close state wherein the cap 113 closes the inlet port 112 is a state that the inlet port 112 of the ink tank 100 is closed by the cap 113 with respect to the outside thereof, and that the ink cannot be poured into the ink chamber 111 via the inlet port 112 from the outside of the ink tank 100. The open state wherein the cap 113 allows the inlet port 112 to be opened (released) is a state that the cap 113 is detached (removed) from the inlet port 112 and the ink can be poured into the ink chamber 111 via the released inlet port 112 from the outside of the ink tank 100. As depicted in FIGS. 1A and 1B, the cap 113 is provided as four caps 113B, 113M, 113C and 113Y corresponding to the four inlet ports 112B, 112M, 112C and 112Y of the ink tank 100, respectively. The respective caps 113B, 113M, 113C and 113Y are colored in the colors of the inks stored in the ink chambers 111 corresponding to the caps 113B, 113M, 113C and 113Y, respectively. Specifically, the cap 113B is colored in black, the cap 113M is colored in magenta, the cap 113C is colored in cyan and the cap 113Y is colored in yellow. Since the respective caps 113B, 113M, 113C and 113Y have a same shape, the caps 113B, 113M, 113C and 113Y are collectively referred to as the "cap 113(*s*)" and will be described in details in the following explanation.

Figure 8A:
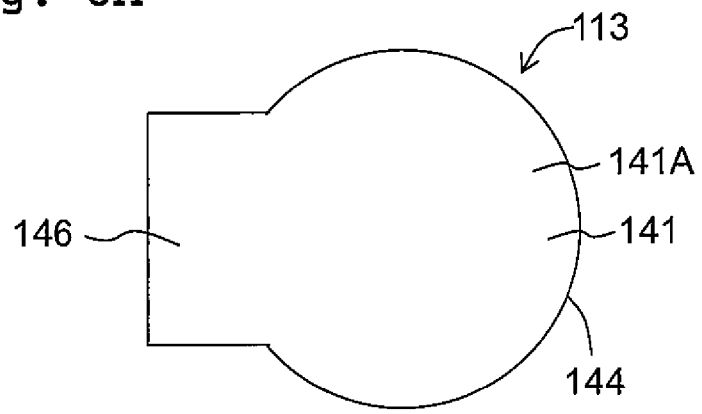
Figure 8B:
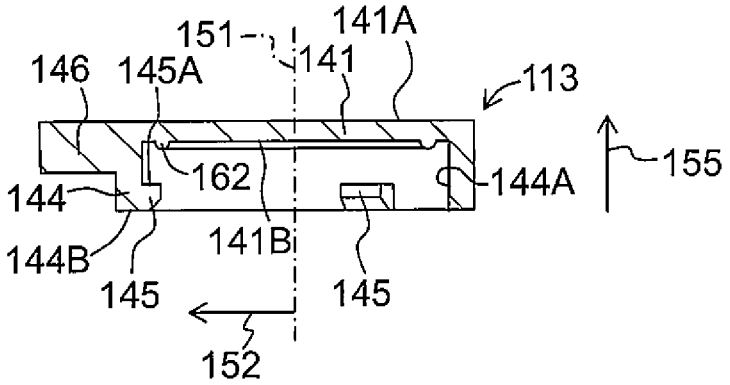
Figure 8C:
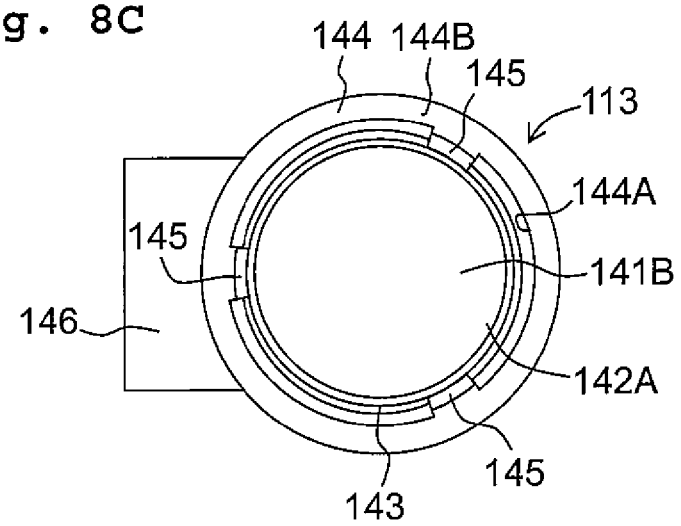

The cap 113 is formed, for example, of a synthetic resin such as polypropylene (PP). Although the synthetic resin used to form the cap 113 has a high modulus of elasticity as compared with an elastic material such as rubber, elastomer, etc., the synthetic resin is a material which is elastically deformable. As depicted in FIGS. 8A to 8C, the cap 113 has a substantially columnar outer shape. Since the cap 113 is formed of the elastically deformable material, the cap 113 is thus deformed when the cap 113 is attached or detached with respect to the inlet port 112, and then returns to the original shape of the cap 113. By allowing the cap 113 to have the high modulus of elasticity as compared with the rubber, elastomer, etc., a holding portion 146 (to be described later on) is not easily bent. Therefore, in a case that the user lifts or raises the holding portion 146, a portion of the cap 113 connected to the holding portion 146 easily moves following the holding portion 146.

The cap 113 is provided with a lid portion 141, a seal portion 162, a connecting portion 144, three projections 145 and a holding portion 146.

The lid portion 141 has a disc-shape with the central axis line 151 as the center thereof. The outer diameter of the lid portion 141 is greater than the outer diameter of the cylindrical wall 121. A surface, of the lid portion 141, facing the first direction 155 is defined as a front surface 141A, and a surface, of the lid portion 141, facing a direction opposite to the first direction 155 is defined as a back surface 141B.

The holding portion 146 has a rectangular plate-like shape. The holding portion 146 extends outwardly from the periphery or peripheries of the lid portion 141 and/or the connecting portion 144, in the radial directions of the cylindrical wall 121 and the inlet port 112 which are orthogonal to the central axis line 151.

In this configuration, the seal portion 162 is arranged to project in the direction opposite to the first direction 155 from the back surface 141B of the lid portion 141, as depicted in FIGS. 6A, 6B and FIG. 8B. The seal portion 162 has a ring shape. The central axis of the ring shape in the seal portion 162 is coincident with the central axis line 151. The central diameter of the seal portion 162 (or the average diameter of the inner and outer diameters of the seal portion 162) relative to the central axis line 151 is substantially same as the central diameter of the first portion 174 of the cylindrical wall 121 (or the average diameter of the inner and outer diameters of the first portion 174 of the cylindrical wall 121) relative to the central axis line 151.

The connecting portion 144 has a cylindrical shape. The connecting portion 144 is projecting from the back surface 141B of the lid portion 141 in the direction opposite to the first direction 155. The connecting portion 144 has a central axis of the cylindrical shape thereof which is coincident with the central axis line 151. The inner diameter of the connecting portion 144 is greater than the outer diameter of the seal portion 162. Further, the inner diameter of the connecting portion 144 is greater than the outer diameter of the first portion 174 of the cylindrical wall 121. The connecting portion 144 is provided on the outside, in the radial direction of which center is the central axis line 151, of the seal portion 162, with an interval (spacing distance, gap) with respect to the seal portion 162.

An inner circumferential surface 144A of the connecting portion 144 extends, in the direction opposite to the first direction 155, from the back surface 141B of the lid portion 141. The three projections 145 are projecting toward the central axis line 151 from an end edge portion 144B, which faces the direction opposite to the first direction 155, in the inner circumferential surface 144A of the connecting portion 144. The three projections 145 have a same shape, and each have a substantially flat plate-like shape expanding along a plane orthogonal to the central axis line 151. The three projections 145 are arranged with an interval therebetween (while being spaced from one another), in the circumferential direction of the inner circumferential surface 144A of the connecting portion 144, namely the circumferential direction with the first direction 155 and the central axis line 151 as the center thereof. The three projections 145 are arranged in the circumferential direction at equal intervals therebetween. Namely, an orthogonal line extending toward the central axis line 151 from the center of a certain projection 145 among the three projections 145 defines an angle of 120 degrees with each of orthogonal lines extending toward the central axis line 151 respectively from the centers of other projections 145 among the three projections 145. A surface, in the projection 145, facing the first direction 155 forms an abutting surface 145A having a plane orthogonal to the central axis line 151. A surface, of the projection 145, facing the direction opposite to the first direction 155, forms a guide surface 145B which is inclined with respect to the first direction 155 so as to approach more closely to the back surface 141B of the lid portion 141 as approaching more closely to the central axis line 151. The diameter of a virtual cylindrical surface, defined by end surfaces of the respective projections 145 (surfaces of the projections 145 located most closely to the central axis line 151) is smaller than the outer diameter of the first portion 174 of the cylindrical wall 121, and is greater than the outer diameter of the second portion 175 of the cylindrical wall 121. In a case that the cap 113 is seen from the first direction 155, the center of one projection 145, among the three projections 145, which is arranged closest to the holding portion 146 is arranged side by side with the center of the holding portion 146 in the radial directions of the cylindrical wall 121 and the inlet port 112.

<Ink Injection Container 181>

Figure 9A:
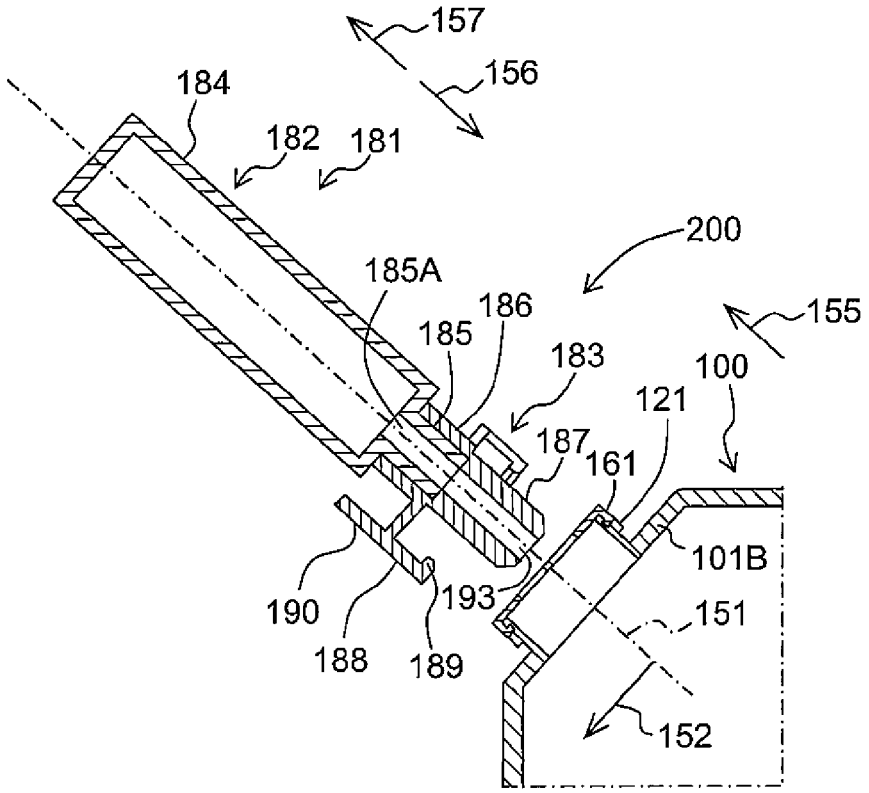
Figure 9B:
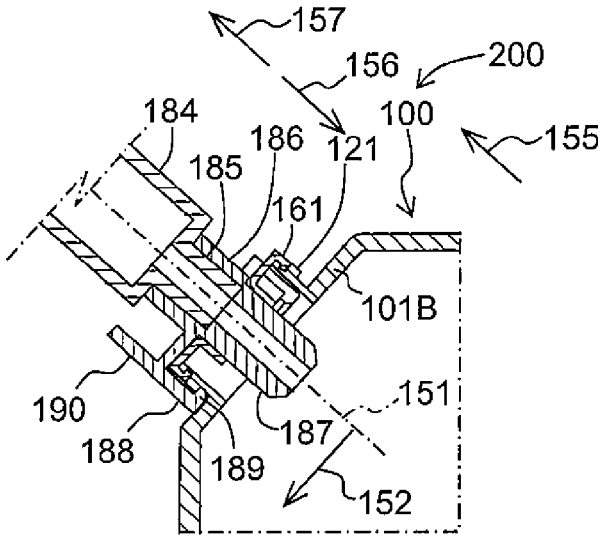

In a case that the ink tank 100 is to be replenished with an ink, an ink injection container 181 is used, as depicted in FIGS. 9A and 9B. The ink injection container 181 is an example of a liquid injection container. The ink tank 100 and the ink injection container 181 construct a system 200. The ink injection container 181 is provided with a bag 182 and a spout 183. Note that in the following explanation, in a case that the positional relationship between elements or parts constructing the ink injection container 181 and the central axis line 151 is described, it is interpreted to describe the positional relationship between the elements or parts constructing the ink injection container 181 and the central axis line 151 of the cylindrical wall 121 and the inlet port 112 in a state that the ink injection container 181 is inserted into the inlet port 112 and the first direction 155 and a second direction 156 (to be described later on) are parallel to each other and opposite to each other.

<Bag 182>

Figure 10:
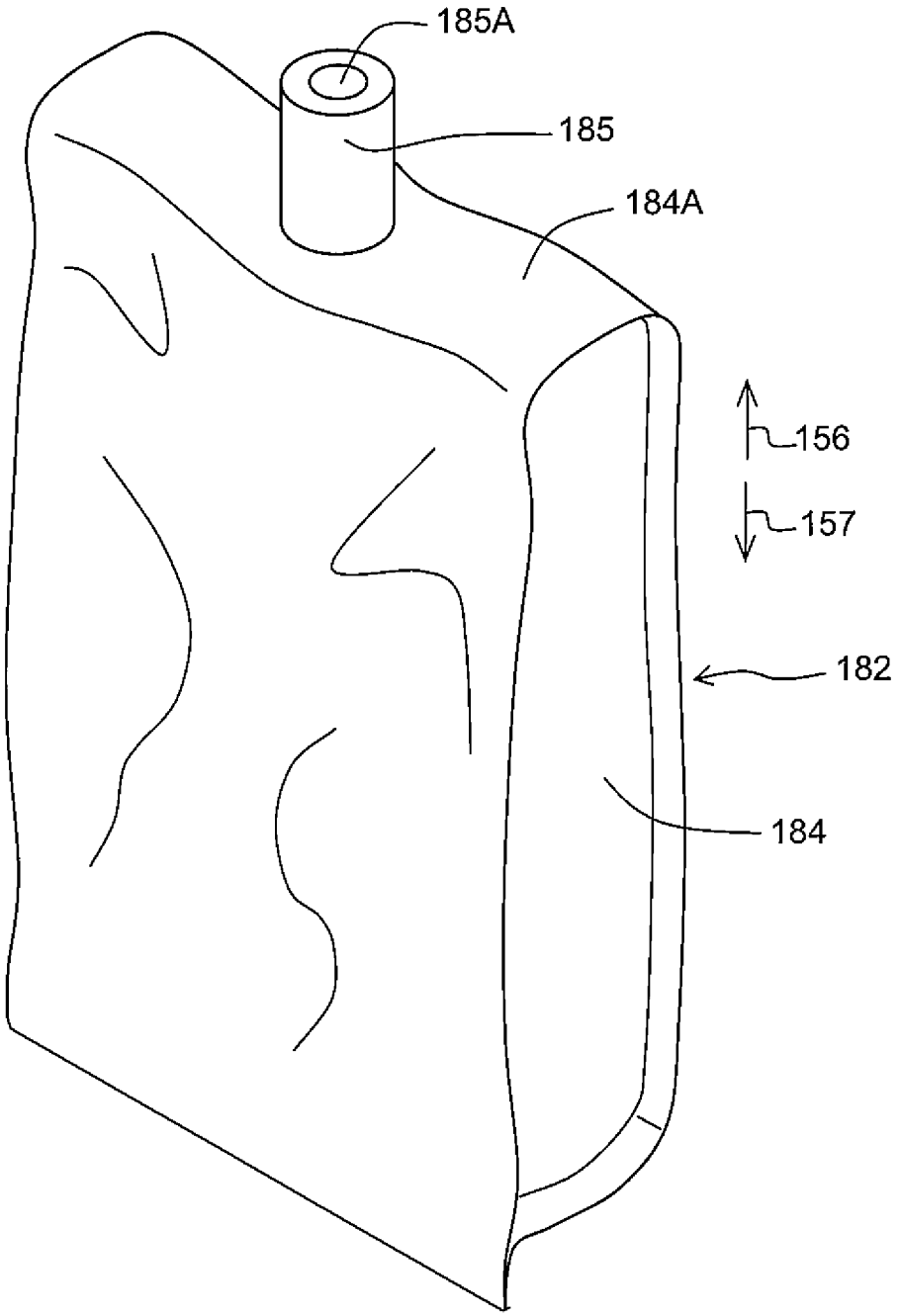
FIG. 10 is a perspective view of a bag 182.

As depicted in FIG. 10, the bag 182 is provided with an ink storing portion 184 and a spout attachment portion 185. The ink storing portion 184 is an example of a liquid storing portion. The ink storing portion 184 is, for example, a bag formed of a pouch sheet (also referred to as a laminated sheet). The pouch sheet is, for example, a sheet formed by adhering an aluminum film and a resin film to each other. The shape of the ink storing portion 184 is not particularly limited, and the ink storing portion 184 may have, for example, a bottle-like shaped or a bag-like shape. An ink is stored in the ink storing portion 184. The spout attachment portion 185 is projected from a central portion in a surface 184A, of the ink storing portion 184, which faces or is oriented in the second direction 156, in a cylindrical form toward the second direction 156. The spout attachment portion 185 is formed, for example, of a synthetic resin such as PE (polyethylene), etc. The spout attachment portion 185 is, for example, welded to the ink storing portion 184. The spout attachment portion 185 has an inner passage 185A extending in the second direction 156, and the inside (inner space) of the ink storing portion 184 is communicated with the inner passage 185A of the spout attachment portion 185. Accordingly, the inside of the ink storing portion 184 is communicated with the outside of the ink storing portion 184 via the spout attachment portion 185.

<Spout 183>

Figure 11:
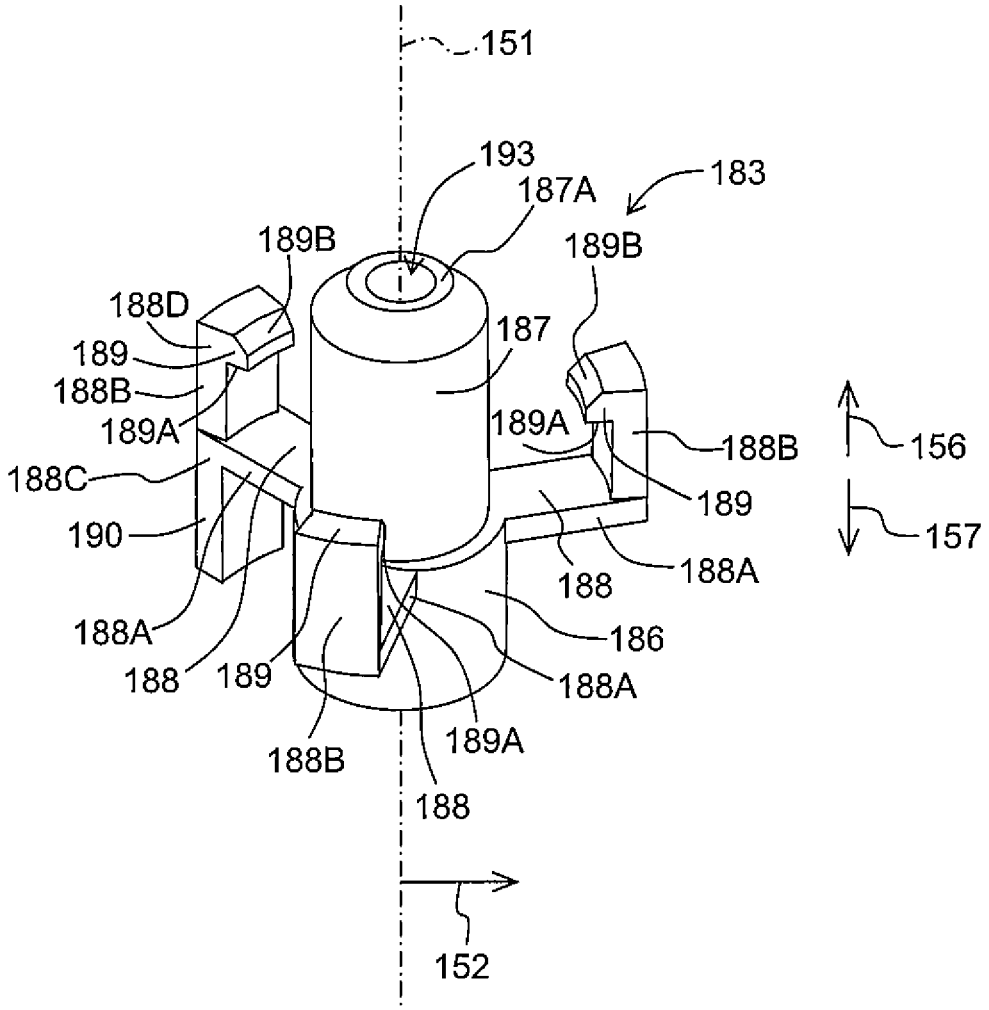
FIG. 11 is a perspective view of a spout 183.

The spout 183 is an example of a liquid discharging portion. As depicted in FIG. 11, the spout 183 is provided with a bag attachment portion 186, an insertion portion 187, three arms 188, craws 189 corresponding to the three arms 188 respectively, and a release arm 190. The spout 183 is formed, for example, of a synthetic resin such as PE, etc.

The bag attachment portion 186 has a cylindrical shape with the central axis line 151 extending along the second direction 156 as the center thereof. The inner diameter of the bag attachment portion 186 is smaller to some extent than the outer diameter of the spout attachment portion 185 of the bag 182 as depicted in FIG. 10. By forcibly inserting (pressing) the spout attachment portion 185 of the bag 182 into the inside of the bag attachment portion 186, the bag attachment portion 186 and the spout attachment portion 185 are fixed to each other, thereby constructing the ink injection container 181 as depicted in FIGS. 9A and 9B. It is also allowable that male screw and female screw are formed in the outer circumferential surface of the spout attachment portion 185 and in the inner circumferential surface of the bag attachment portion 186, respectively, to thereby form the spout attachment portion 185 and the bag attachment portion 186 to be threadable to each other.

The insertion portion 187 has a substantially cylindrical shape with the central axis line 151 as the center thereof. The insertion portion 187 is extended in the second direction 156 from an end surface, of the bag attachment portion 186, facing the second direction 156. An end portion, of the insertion portion 187, facing the second direction 156 has a tapered shape of which outer diameter becomes smaller toward the tip end of the insertion portion 187. The inner circumferential surface of the insertion portion 187 is extended along the central axis line 151, and is opened at the tip end, of the insertion portion 187, facing the second direction 156. The inner circumferential surface of the insertion portion 187 forms an ink discharge passage 193. The inner passage 185A of the spout attachment portion 185 of the bag 182 and the ink discharge passage 193 of the spout 183 are an example of a liquid discharge passage. The outer diameter of the insertion portion 187 is smaller than the diameter of the inlet port 112.

The three arms 188 are arranged on the outer circumferential surface of the end portion, of the bag attachment portion 186, facing the second direction 156. The three arms 188 have a same shape. The three arms 188 are arranged in the circumferential direction, at equal intervals therebetween, with the central axis line 151 along the second direction 156 as the center of the circumferential direction. Namely, an orthogonal line extending toward the central axis line 151 from the center of a certain arm 188 among the three arms 188 defines an angle of 120 degrees with each of orthogonal lines extending toward the central axis line 151 respectively from the centers of other arms 188 among the three arms 188. Each of the arms 188 is constructed of a first arm portion 188A and a second arm portion 188B. The first arm portion 188A has a flat plate-like shape expanding along a plane orthogonal to the central axis line 151. The second arm portion 188B has a curved plate-like shape expanding along a circumferential surface with the central axis line 151 as the center thereof. The first arm portion 188A is extending from the bag attachment portion 186 in an outward direction 152 in a radial direction with the central axis line 151 as the center thereof. The second arm portion 188B is extending in the second direction 156 from an end portion 188C, in the first arm portion 188A, which is away from the bag attachment portion 186.

Each of the craws 189 is arranged on an end portion 188D, in the second direction 156, of the second arm portion 188B in one of the arms 188. The craw 189 has a substantially flat plate-like shape expanding along a plane orthogonal to the central axis line 151. The craw 189 is extending from the end portion 188D of each of the arms 188 in a direction approaching toward the central axis line 151, up to a position away from the outer circumferential surface of the insertion portion 187 with a spacing distance (clearance). A surface, in the craw 189, facing a third direction 157 that is an opposite direction to the second direction 156, forms an abutting surface 189A. The abutting surface 189A is extending along the plane orthogonal to the central axis line 151. A surface, of the craw 189, in the second direction 156 forms a guide surface 189B which is inclined with respect to the central axis line 151 so as to approach more closely to the abutting surface 189A as approaching more closely to the central axis line 151. The three craws 189 are arranged inside a virtual surface orthogonal to the second direction 156, at equal intervals therebetween on the circumference of a virtual circle drawn with the central axis line 151 which is along the second direction 156 as the center of the virtual circle.

The release arm 190 is provided on one arm 188, among the three arms 188, while extending in the third direction 157 from the end portion 188C of the first arm portion 188A of the one arm 188. The release arm 190 has a curved plate-like shape expanding along a circumferential surface with the central axis line 151 as the center thereof. In a case that a force approaching toward the central axis line 151 is applied to the release arm 190 by the user, then the first arm portion 188A is curved, thereby moving the end portion 188C of the first arm portion 188A in the third direction 157. As a result, the end portion 188D of the second arm portion 188B is moved to the outside in the radial direction, which in turn causes the craw 189 to move to the outside of the radial direction, accompanying with the outward movement of the end portion 188D in the radial direction. The release arm 190 is an example of an operation portion.

<Attachment of the Inner Lid 161 to the Inlet Port 112>

The inner lid 161 is attached to an end portion, of the cylindrical wall 121, in the first direction 155 such that the central axis of the inner lid 161 is coincident with the central axis of the cylindrical wall 121, as depicted in FIG. 6B. The central axis line 151 of the cylindrical wall 121 is also the central axis line 151 of the inner lid 161. In a state that the inner lid 161 is attached to the cylindrical wall 121, the projecting portion 165 of the inner lid 161 is fitted into the recess formed between the outer circumferential surface of the end portion 172 and the outer circumferential surface of the first portion 174 of the cylindrical wall 121. Since the inner diameter of the projecting portion 165 is substantially same as the outer diameter of the end portion 172, the inner lid 161 is fixed to the cylindrical wall 121. The end portion 172 of the cylindrical wall 121 is sandwiched or held between the extending portion 164 and the projecting portion 165 of the inner lid 161. The inner circumferential surface of the peripheral portion 163 of the inner lid 161 abuts against the outer circumferential surface of the end portion 172 of the cylindrical wall 121, and the inner circumferential surface of the projecting portion 165 abuts against the outer circumferential surface of the inner lid-engaging portion 173, thereby causing the central axis line 151 of the inner lid 161 to be coincident with the central axis line 151 of the cylindrical wall 121. Since the outer circumferential surface of the inner lid 161 and the outer circumferential surface of the first portion 174 have a same diameter, the outer circumferential surface of the inner lid 161 and the outer circumferential surface of the first portion 174 are thereby allowed to be located on one virtual cylindrical surface. The extending portion 164 of the inner lid 161 covers the opening defined by the end portion 172, of the cylindrical wall 121, in (facing) the first direction 155. The inner lid 161 is generally used without being detached from the cylindrical wall 121. Therefore, the inner lid 161 can be considered as a portion of the cylindrical wall 121, and the surface 164A, of the inner lid 161, facing the first direction 155 can be also considered as an end surface 171B of the cylindrical wall 121.

<Attachment and Detachment of the Cap 113 with Respect to the Inlet Port 112>

In a case that the cap 113 is to be attached to the inlet port 112, the user presses the cap 113 toward the inlet port 112 such that the cylindrical wall 121 is inserted into the inside of the connecting portion 144 of the cap 113. In this situation, the surface 164A, of the extending portion 164 of the inner lid 161, located at a location above the end surface 171B of the cylindrical wall 121 with respect to the first direction 155, abuts against (contacts) the guide surface 145B of each of the projections 145 while a force moving the cap 113 in the direction opposite to the first direction 155 is applied to the cap 113. With this, the connecting portion 144 is elastically deformed such that the diameter of the connecting portion 144 is expanded (increased) to thereby move the projections 145 to the outside of the radial directions of the cylindrical wall 121 and the inlet port 112. As result, the diameter of the virtual cylindrical surface defined by the end surfaces of the three projections 145 is expanded (increased). When the cap 113 is to be attached to (installed in) the inlet port 112, whether or not the center of the holding portion 146 and the center of a certain projection 145, among the three projections 145, which is located closely (near) to the holding portion 146 are arranged side by side to each other in the radial directions of the cylindrical wall 121 and the inlet port 112 provided that the cap 113 is seen from the first direction 155 does not particularly affect the action of attachment of the cap 113 to the inlet port 112.

In a case that the cap 113 is continuously pressed into the inlet port 112, the projections 145 pass the first portion 174, of the cylindrical wall 121, of which outer diameter is greater than the diameter of the virtual cylindrical surface defined by the end surfaces of the respective projections 145, and achieves an installed state as depicted in FIG. 6B. In the installed state, each of the projections 145 is located at a position at which the projection 145 is adjacent, in the radial direction of the cylindrical wall 121, to the second portion 175, of the cylindrical wall 121, of which outer diameter is smaller than the diameter of the virtual cylindrical surface defined by end surfaces of the respective projections 145. With this, each of the projections 145 is in a state that the force elastically deforming the connecting portion 144 toward the outside of the radial directions of the cylindrical wall 121 and the inlet port 112, which has been applied to each of the projections 145 by the first portion 174 of the cylindrical wall 121, is not applied to each of the projections 145. As a result, the elastic deformation of the connecting portion 144 is returned to the original shape of the connecting portion 144. In the installed state, the abutting surface 145A of each of the projections 145 faces and abuts against the second connecting surface 177 of the cylindrical wall 121, in the first direction 155. With this, the projections 145 and the second portion 175 are engaged with each other, thereby fixing the cap 113 to the cylindrical wall 121. In the installed state, the seal portion 162 abuts against the surface 164A of the extending portion 164 of the inner lid 161.

In the state that the projections 145 are engaged with the second portion 175, the position of the end portion, of the seal portion 162, facing opposite to the first direction 155 is located on the opposite side with respect to the first direction 155 (located to be below in the direction opposite to the first direction 155) relative to the surface 164A of the extending portion 164 of the inner lid 161. Therefore, a portion, of the surface 164A in the extending portion 164, against which the seal portion 162 abuts is elastically deformed. In the state that the cap 113 is installed in the inlet port 112, the seal portion 162 makes a pressurized contact with the surface 164A of the inner lid 161 which is located to be above in the first direction 155 relative to the end surface 171B of the cylindrical surface 121, thereby sealing the inlet port 112 in the liquid-tight manner.

In a case of removing (detaching) the cap 113 from the inlet port 112, the user lifts (raises) the holding portion 146 of the cap 113 in the first direction 155 and the direction toward the central axis line 151. In this situation, a portion, of the connecting portion 144, connected to the holding portion 146 is elastically deformed in the direction separating away from the cylindrical wall 121. Then, the certain projection 145, among the three projections 145, which is arranged side by side with the holding portion 146 in the radial directions of the cylindrical wall 121 and the inlet port 112, under the condition that the cap 113 is seen from the first direction 155, is moved to a position outside of the radial direction. As a result, the certain projection 145 is moved to a position at which the abutting surface 145A of the certain projection 145 and the second connecting surface 177 do not face each other in the first direction 155. In a case that the abutting surface 145A of the one (certain) projection 145 does not face the second connecting surface 177 in the first direction 155, the holding portion 146 is then moved in the first direction 155 and the direction toward the central axis line 151, thereby moving also the abutting surfaces 145A of the remaining projections 145 among the three projections 145 to positions at which the abutting surfaces 145A of the remaining projections 145 do not face the second connecting surface 177 in the first direction 155. As a result, the cap 113 is removed (detached) from the inlet port 112.

<Attachment and Detachment of the Ink Injection Container 181 with Respect to the Inlet Port 112>

In a case that the ink is to be injected to the ink tank 100 by the user, the user presses the ink injection container 181 toward the inlet port 112 such that the insertion portion 187 of the ink injection container 181 in the state that the spout 183 is attached to the bag 182 is inserted into the inlet port 112 of the ink tank 100 while the first direction 155 is made to be coincident with the third direction 157, as depicted in FIGS. 9A and 9B. In this situation, the inner lid 161, located at a location above the end surface 171B of the cylindrical wall 121 with respect to the first direction 155, abuts against (contacts) the guide surface 189B of each of the craws 189 while a force moving the spout 183 in the third direction 157 is applied to the spout 183. With this, the second arm portion 188B of each of the arms 188 is elastically deformed such that the diameter thereof is expanded (increased) to thereby move the craws 189 to the outside of the radial directions of the cylindrical wall 121 and the inlet port 112. As result, the diameter of the virtual cylindrical surface defined by the end surfaces of the three craws 189 is expanded (increased).

Further, the extending portion 164 of the inner lid 161 abuts against the insertion portion 187 of the spout 183, thereby causing a portion, of the extending portion 164, which abuts against the insertion port 187 to be pressed (pushed) and bent toward the inside of the ink tank 100.

In a case that the ink injection container 181 is continuously pressed into the inlet port 112, the craws 189 pass the first portion 174, of the cylindrical wall 121, of which outer diameter is greater than the diameter of the virtual cylindrical surface defined by the end surfaces of the respective craws 189, and achieves an installed state as depicted in FIG. 9B. In the installed state, each of the craws 189 is located at a position at which the craw 189 is adjacent, in the radial direction of the cylindrical wall 121, to the second portion 175, of the cylindrical wall 121, of which outer diameter is smaller than the diameter of the virtual cylindrical surface defined by end surfaces of the respective craws 189. With this, each of the craws 189 is in a state that the force elastically deforming the second arm portion 188B toward the outside of the radial directions of the cylindrical wall 121 and the inlet port 112, which has been applied to each of the craws 189 by the first portion 174 of the cylindrical wall 121, is not applied to each of the craws 189. As a result, the elastic deformation of the second arm portion 188B is returned to the original shape of the second arm portion 188B. In the installed state, the three craws 189 hold the outer circumferential surface of the second portion 175 of the cylindrical wall 121 from the three directions, respectively; further, the abutting surface 189A of each of the craws 189 faces and abuts against the second connecting surface 177 of the cylindrical wall 121, in the first direction 155. With this, the craws 189 and the second portion 175 are engaged with each other, thereby fixing the ink injection container 181 to the cylindrical wall 121.

When the ink injection container 181 is fixed to the cylindrical wall 121, the user holds the bag 182 so as to compress the bag 182, thereby allowing the ink inside the ink injection container 181 to be poured into the ink tank 100.

Since the outer diameter of the insertion portion 187 of the spout 183 is smaller than the diameter of the inlet port 112, a gap is defined between the insertion portion 187 and the inner circumferential surface 171A, of the cylindrical wall 121 and of the inclined wall 101B defining the inlet port 112, in a state that the ink injection container 181 is fixed to the inlet port 112. This gap allows the inflow and outflow of the air. Even in the case that the inner lid 161 is attached to the cylindrical wall 121, the air inflow and outflow is possible owing to a gap defined between the insertion portion 187 and an opening defined by the cutout portion 167 formed in the inner lid 161 which is elastically deformed.

In a case of removing (detaching) the ink injection container 181 from the ink tank 100, the user pinches the release arm 190 and the bag attachment portion 186 by, for example, the thumb and the index finger, and applies a force in such a direction that allows the release arm 190 and the bag attachment portion 180 approach toward each other. With this, the first arm portion 188A of one arm 188 which is included in the three arms 188 and which is provided with the release arm 190 is elastically deformed such that the end portion 188C of the first arm portion 188A of the one arm 188 is moved in the third direction 157, and the end portion 188D of the second arm portion 188B of the one arm 188 is moved in a direction 152 away from the central axis line 151. Then, the one arm 188 provided with the release arm 190 is moved to a position at which the abutting surface 189A of the craw 189 does not face the second connecting surface 177 in the first direction 155. Further, when the user moves the ink injection container 181 in the first direction 155 while the state that the abutting surface 189A is separated and away from the second connecting surface 177 is maintained, the ink injection container 181 is thereby removed (detached) from the ink tank 100.

As described above, the user supplies the ink to the ink tank 100 in the state that the spout 183 of the ink injection container 181 is inserted into the inlet port 112 of the ink tank 100. In the ink tank 100 of the present embodiment, the first direction 155 crosses the vertical direction in the state that the spout 183 is inserted into the inlet port 112. Accordingly, the spout 183 is easily detached or easily comes off from the inlet port 112 due to the gravity. In this state, however, the three craws 189 of the ink injection container 181 are brought into contact, from the three directions, respectively, with the second connecting surface 177 of the cylindrical wall 121 of the ink tank 100, toward the first direction 155. With this, the ink injection container 181 is easily fixed to the ink tank 100, and it is possible to suppress any detachment of the ink injection container 181 from the ink tank 100 when the ink is (being) supplied to the ink tank 100.

Since the three craws 189 are arranged inside the virtual surface orthogonal to the central axis line 151, at equal intervals therebetween on the circumference of a virtual circle drawn with the central axis line 151 as the center of the virtual circle, the positions at which the ink injection container 181 is fixed with respect to the ink tank 100 can be equally distributed (dispersed) in the circumferential direction of which center is the central axis line 151 of the spout 183, thereby allowing the ink injection container 181 to be fixed to the ink tank 100 more stably.

The user performs an operation for moving the release arm 190, in the direction approaching toward the center of the spout 183, thereby making it possible to elastically deform the one arm 188 among the three arms 188 and provided with the release arm 190. This releases the contact between the second connecting surface 177 and the craw 189 of the one arm 188 which is included in the plurality of arms 188.

The bag 182 can be easily deformed. Thus, for example, in such a case that a plurality of pieces of the liquid injection container 181 are packed in a box, the liquid injection containers 181 can be packed in a greater number and with less gaps therebetween.

The cap 113 has the seal portion 162 and the projections 145 which are provided independently from each other. The seal portion 162 has the sealing function to seal the inlet port 112 in the liquid-tight manner. The projections 145 have the function of suppressing any detachment of the cap 113 from the inlet port 112. Since the three projections 145 are provided on the cap 113 while being spaced from one another in the circumferential direction of which center is the central axis line 151, the cap 113 is elastically deformed with a force smaller than a force in a case that the projections 145 are provided on the cap 113 along the entire circumference thereof in the circumferential direction. Thus, the user can install the cap 113 in the inlet port 112 by moving the cap 113, with a relatively small force, up to the position at which the abutting surface 145A of each of the projections 145 can face the second connecting surface 177 of the ink tank 100 in the first direction 155. Similarly, the user can remove the cap 113 from the inlet port 112 by releasing the contact of the abutting surface 145A of each of the projections 145 with respect to the second connecting surface 177 of the ink tank 100, with a relatively small force.

Further, when the cap 113 is (being) detached from the inlet port 112, the force by which the cap 113 that has been elastically deformed returns to its original shape is small. Thus, even if any ink is adhered to the cap 113, it is possible to suppress any scattering of the ink adhered to the cap 113.

Furthermore, since the seal portion 162 and the projections 145 are provided independently from each other, the sealing function of the seal portion 162 is not lowered even through the projections 145 are not provided along the entire circumference of the cap 113.

Moreover, in a case that the cap 113 is being moved toward the first direction 155 from the state of being installed in the inlet port 112, the abutting surface 145A of each of the projections 145 contacts the second connecting surface 177 of the cylindrical wall 121, and forces mutually pressing in opposite directions act on the space between the abutting surface 145A of each of the projections 145 and the second connecting surface 177 of the cylindrical wall 121. Thus, in a case that the internal pressure in the ink tank 100 becomes greater than the atmospheric pressure, or in another case that the ink tank 100 is turned upside down in the up-down direction and the weight of the ink inside the ink tank 100 is applied to the cap 113, there is little fear that the cap 113 installed in the inlet port 112 might be detached or come off from the inlet port 112.

The cutout portion 167 formed in the extending portion 164 of the inner lid 161 is closed by the elasticity of the extending portion 164 itself in a state that the spout 183 is not inserted into the inlet port 112. Accordingly, the extending portion 164 of the inner lid 161 suppresses any outflow of the ink from the ink tank 100. Thus, in a state that the cap 113 is removed from the ink tank 100, for example, even if the multi-function peripheral 10 on which the ink tank 100 is provided is dropped or fallen, etc., it is possible to suppress any outflow of the ink from the ink tank 100. Owing to the provision of the inner lid 161, a portion, to which the ink adheres with respect to the cap 113, is limited. With this, it is possible to suppress any scattering of the ink when the cap 113 is attached to or detached from the ink tank 100.

Further, in a case that the user repeatedly performs such an operation to press the bag 182 of the ink injection container 181, when the ink is (being) poured from the ink injection container 181 to the ink tank 100, so that the volume of the bag 182 is suddenly decreased, then the pressure inside the ink tank 100 is suddenly increased with respect to the external pressure of the ink tank 100, in some cases. However, since the pressure is decreased from the gap between the spout 183 and the inner circumferential surface 171A of the cylindrical wall 121 and of the inclined surface 101B defining the inlet port 112 and from the gap between the spout 183 and the extending portion 164 of the inner lid 161, it is possible to suppress any high pressure generating inside the ink tank 100. With this, it is possible to suppress any jetting or spouting of the ink from the ink tank 100 via the inlet port 112 when the spout 183 of the ink injection container 181 is pulled out from the inlet port 112. Further, when the spout 183 of the ink injection container 181 inserted into the inlet port 112 of the ink tank 100 is pulled out, the extending portion 164 rubs or strokes the spout 183; with this, any ink adhered to the spout 183 is wiped off from the spout 183 by the extending portion 164.

Further, the internal pressure and the external pressure of the ink tank 100 are made to be same by the atmosphere communicating hole 132. Furthermore, the semipermeable membrane 133 suppresses any outflowing of the ink to the outside of the ink tank 100 via the atmosphere communicating hole 132.

Moreover, even in a case that, due to any sudden increase in the internal pressure inside the ink tank 100 relative to the external pressure outside the ink tank 100, a time is required for gas to be discharged from the inside to the outside of the ink tank 100 via the semipermeable membrane 133, and thus the increase in the internal pressure of the ink tank 100 cannot be resolved quickly in some cases. However, since the gap is defined between the spout 183 and the inner circumferential surface 171A of the cylindrical wall 121 and of the inclined wall 101B defining the inlet port 112 and between the spout 183 and the extending portion 164 of the inner lid 161, the gas is allowed to exit from the inside to the outside of the ink tank 100 via the gap, thereby suppressing any increase in the internal pressure inside the ink tank 100.

<First Modification>

It is allowable that a cross-shaped opening is formed in the extending portion 164 of the inner lid 164, rather than the cross-shaped cutout portion 167. Since the cross-shaped opening is opened also in a state that the spout 183 is not inserted into the inlet port 112, the effect of suppressing the outflow of the ink from the inlet port 112 is smaller than the configuration provided with the cutout portion 167. However, this configuration with the cross-shaped opening is capable of suppressing the outflow of the ink from the inlet port 112 than in a case that the inner lid 161 is not arranged in the inlet port 112.

Further, it is allowable that the extending portion 164 is formed with a cross-shaped cutout portion of which point of intersection is the central axis line 151, and a through hole penetrating through the extending portion 164 in the first direction 155, at the position of the point of intersection of the cross-shape.

In a case that the cross-shaped cutout portion and the through hole are formed in the extending portion 164, a gap, which is greater than the gap in the configuration formed only with the cross-shaped cutout portion, is defined between the extending portion 164 and the spout 183. Accordingly, the air is allowed to easily exit from the inside of the ink tank 100 via the through hole, thereby making it possible to suppress the increase in the internal pressure inside the ink tank 100. Further, since the periphery portion of the through hole is easily brought into contact with the outer circumferential surface of the insertion portion 187 of the spout 183, the ink adhered to the insertion portion 187 can be wiped off more effectively.

<Second Modification>

Figure 12:
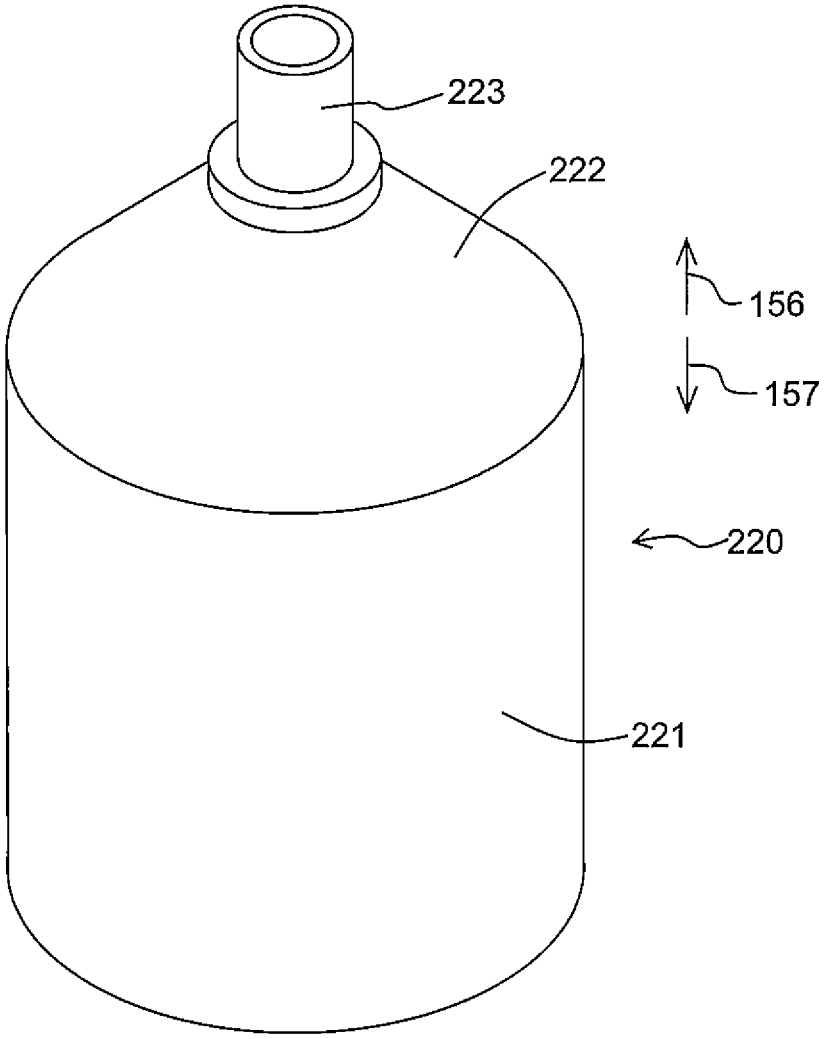
FIG. 12 is a perspective view of a bottle 220 in a second modification.
Figure 13:
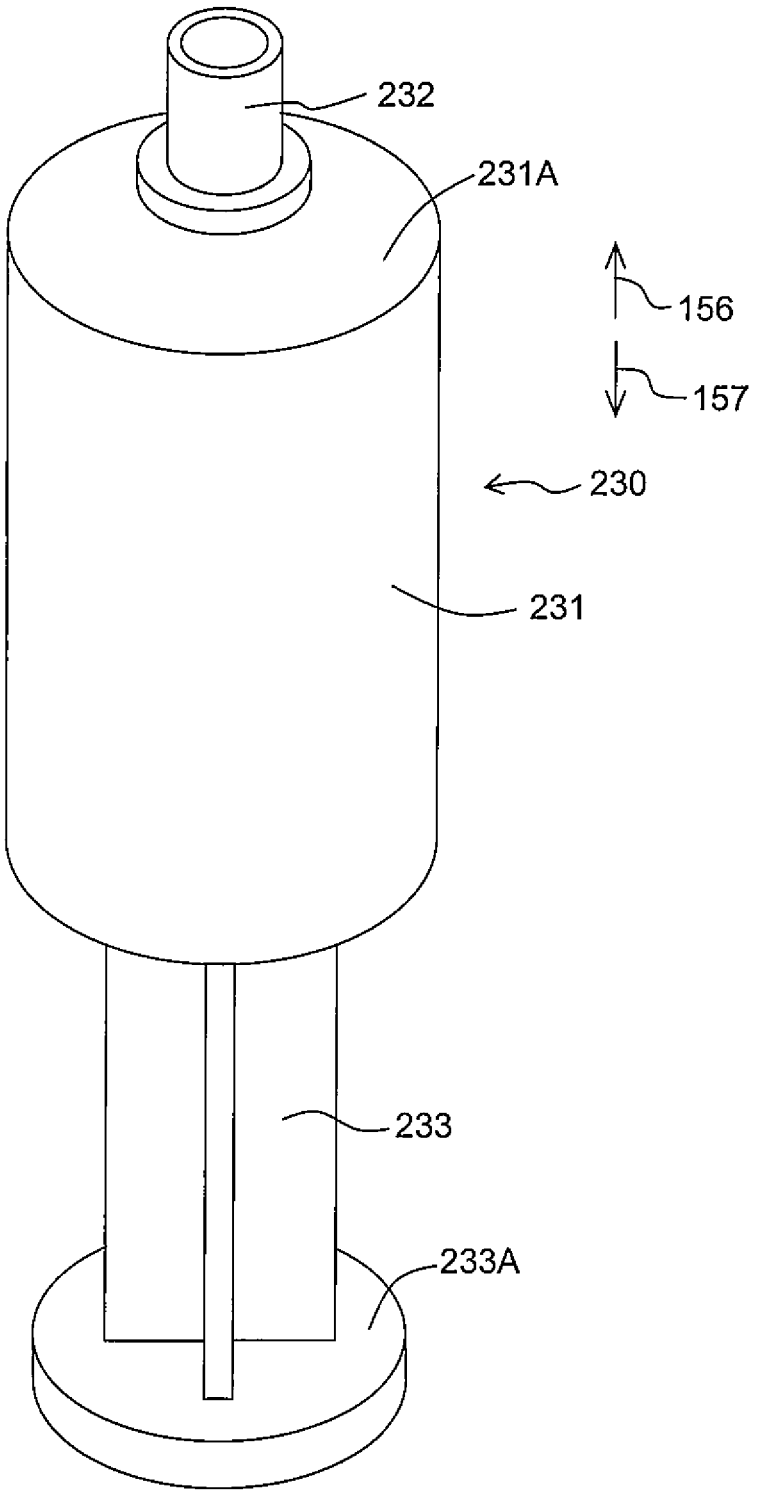
FIG. 13 is a perspective view of a syringe 230 in the second modification.

It is allowable to use, in the ink injection container 181, a bottle 220 as depicted in FIG. 12, a syringe 230 as depicted in FIG. 13, or a bag provided with an ink storing portion 184 formed of a bellows (not depicted in the drawings), rather than using the bag 182 used in the above-described embodiment.

As depicted in FIG. 12, the bottle 220 is provided with an ink storing portion 221 and a spout attachment portion 223. The ink storing portion 221 has, for example, a substantially columnar-shape formed to be hollow inside. An upper surface 222 of the ink storing portion 221 has a substantially conical shape. The spout attachment portion 223 is cylindrically projecting from the apex portion of the conical shape in the upper surface 222 of the ink storing portion 221. The ink storing portion 221 and the spout attachment portion 223 are integrally formed, for example, of a synthetic resin such as PE (polyethylene), etc. The spout attachment portion 223 has an inner passage extending in the second direction 156, and the inside of the ink storing portion 221 is communicated with the inner passage of the spout attachment portion 223. Accordingly, the inside of the ink storing portion 221 is communicated with the outside of the ink storing portion 221 via the spout attachment portion 223.

The syringe 230 is provided with an ink storing portion 231, a spout attachment portion 232 and a piston portion 223, as depicted in FIG. 13. The ink storing portion 231 has a cylindrical shape of which one end is closed. The spout attachment portion 232 is projecting cylindrically from a central portion of an end surface 231A, of the ink storing portion 231, which is a closed end surface. The ink storing portion 231 and the spout attachment portion 232 are integrally formed, for example, of a synthetic resin such as polypropylene (PP), etc. The spout attachment portion 232 has an inner passage extending in the second direction 156, and the inside of the ink storing portion 231 is communicated with the inner passage of the spout attachment portion 232. Accordingly, the inside of the ink storing portion 231 is communicated with the outside of the ink storing portion 231 via the spout attachment portion 233.

The piston portion 233 has a stick-like shape in which two flat plate-like members elongated in the second direction 156 are crossed with each other to form a cross shape as seen from the second direction 156. An end portion, of the piston portion 233, facing the third direction 157 is provided with a push plate 233A having a disc-shape expanding perpendicularly relative to the second direction 156. A seal portion (not depicted in the drawings) formed of an elastic body such as rubber is provided on an end portion, of the piston portion 233, facing the second direction 156. The piston portion 233 is used in such a manner that the piston portion 233 is inserted, from the side thereof provided with the seal portion, to the inside of the ink storing portion 231 from an end portion, of the ink storing portion 231 which is opened and which faces the third direction 157. In this state, the opened end in the ink storing portion 231 is sealed by the seal portion in a liquid-tight manner. With this, the ink is stored inside the ink storing portion 231.

<Third Modification>

Figure 14A:
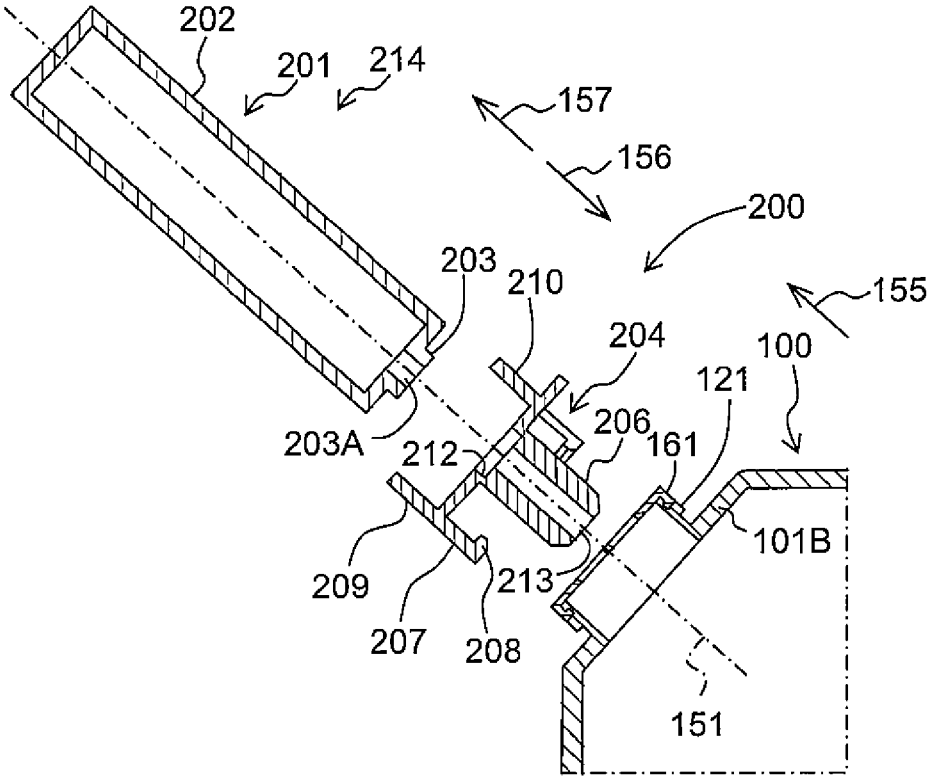
Figure 14B:
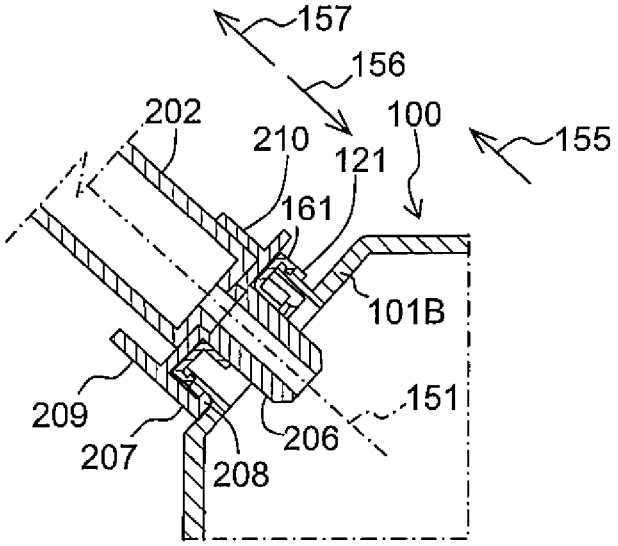
Figure 15:
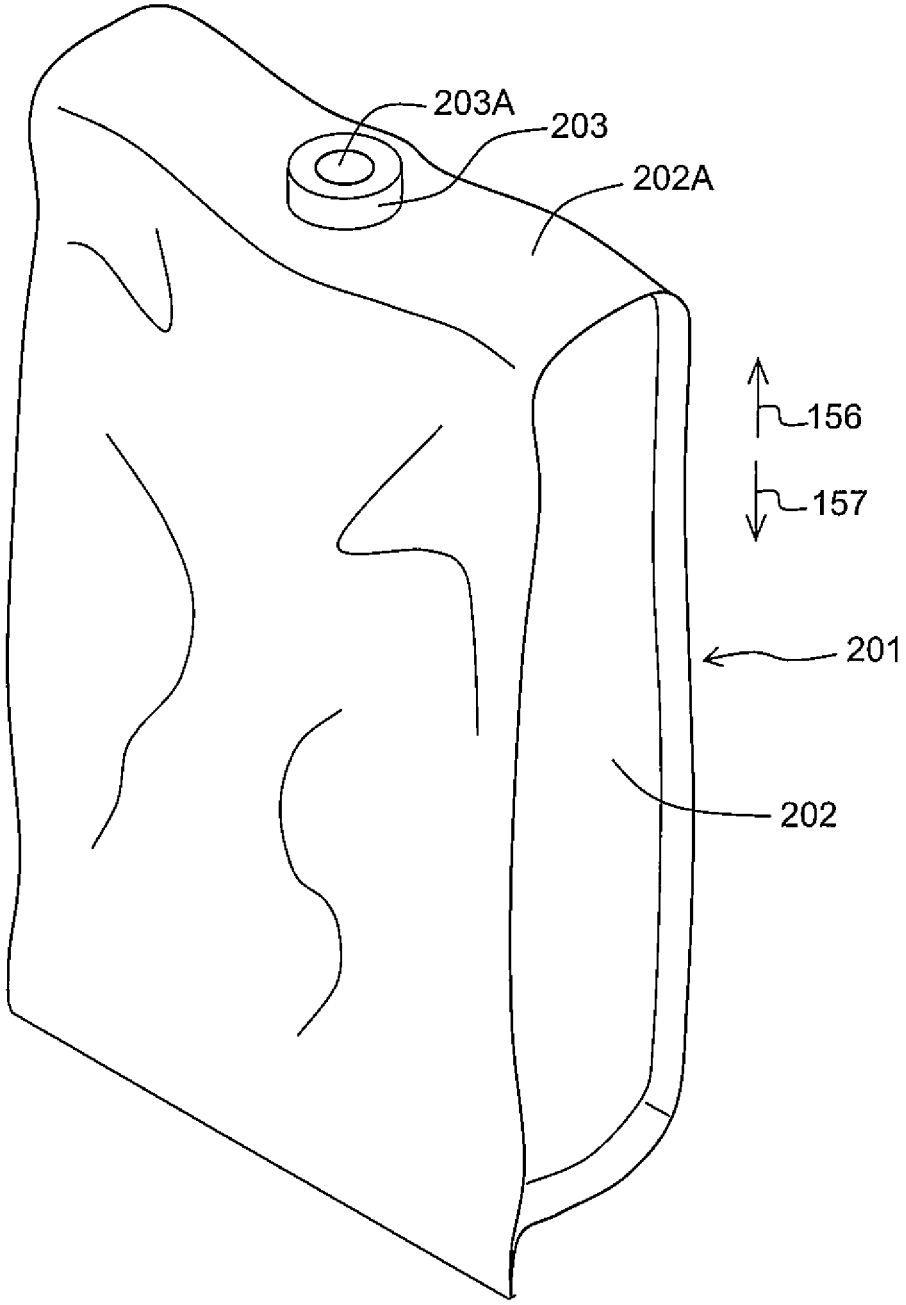
FIG. 15 is a perspective view of a bag 201 in the third modification.
Figure 16:
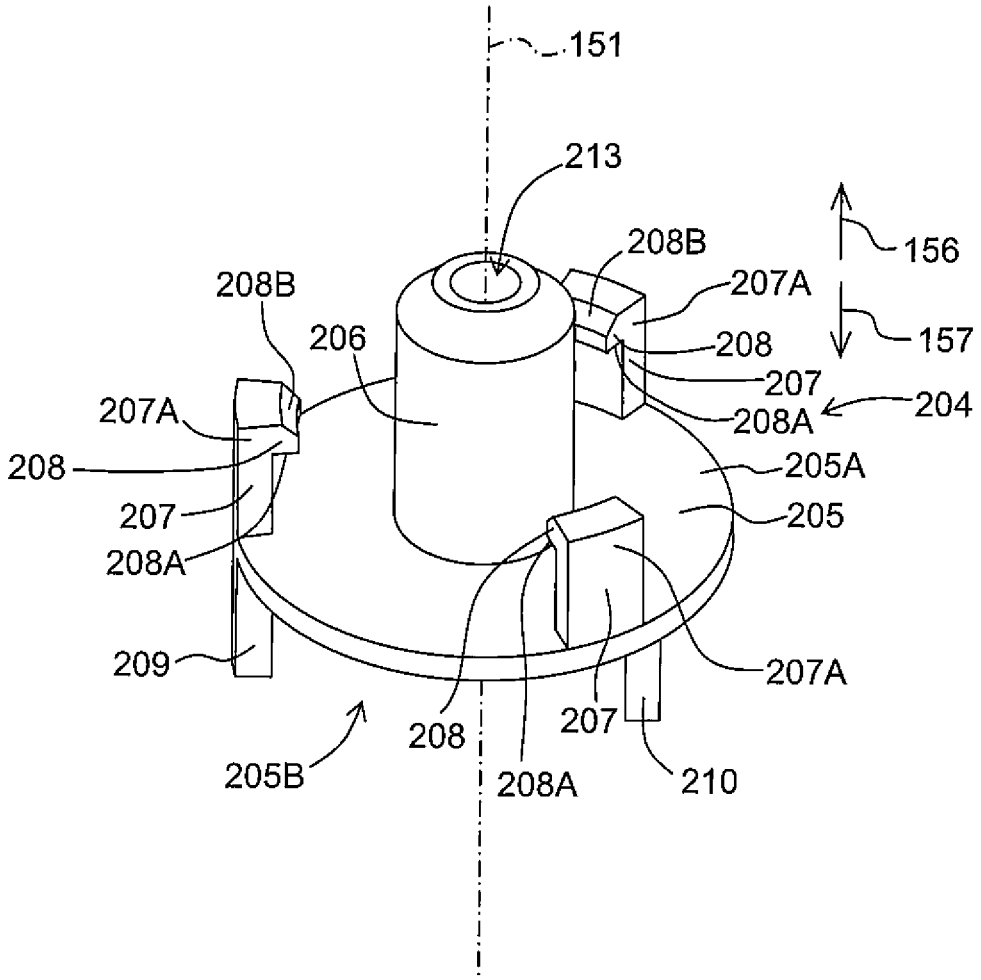
FIG. 16 is a perspective view of a spout 204 in the third modification.

It is allowable to use an ink injection container 214 as depicted in FIGS. 14 to 16, rather than using the ink injection container 181 in the above-described embodiment. The ink injection container 214 is provided with a bag 201 and a spout 204. Note that in the following explanation, in a case that the positional relationship between elements or parts constructing the ink injection container 214 and the central axis line 151 is described, it is interpreted to describe the positional relationship between the elements or parts constructing the ink injection container 214 and the central axis line 151 of the cylindrical wall 121 and the inlet port 112 in a state that the ink injection container 214 is inserted into the inlet port 112 and the first direction 155 and the second direction 156 are parallel to each other and opposite to each other.

As depicted in FIG. 15, the bag 201 is provided with an ink storing portion 202 and a spout attachment portion 203. The ink storing portion 202 is, for example, a bag formed of a pouch sheet. The shape of the ink storing portion 202 is not particularly limited, and the ink storing portion 202 may have a bottle-like shape, a syringe-like shape or may be formed of a bellows, as described above. An ink is stored in the ink storing portion 202. The spout attachment portion 203 is projected from a central portion in a surface 202A, of the ink storing portion 202, which faces or is oriented in the second direction 156, in a cylindrical form toward the second direction 156. The spout attachment portion 203 is formed to have a size or dimension in the second direction 156 which is shorter than that of the spout attachment portion 185 of the above-described bag 182, in order that the spout attachment portion 203 is easily attached to the spout 204. The spout attachment portion 203 is formed, for example, of a synthetic resin such as PE (polyethylene), etc. The spout attachment portion 203 is, for example, welded to the ink storing portion 202. The spout attachment portion 203 has an inner passage 203A extending in the second direction 156, and the inside (inner space) of the ink storing portion 202 is communicated with the inner passage 203A of the spout attachment portion 203. Accordingly, the inside of the ink storing portion 202 is communicated with the outside of the ink storing portion 202 via the spout attachment portion 203.

The spout 204 is an example of the liquid discharging portion. As depicted in FIG. 16, the spout 204 is provided with a disc portion 205, an insertion portion 206, three arms 207, craws 208 corresponding to the three arms 207 respectively, a release arm 209 and an auxiliary arm 210. The auxiliary arm 210 is an example of the operation portion. The spout 204 is formed, for example, of a synthetic resin such as PE, etc.

The disc portion 205 has a substantially disc-like shape of which center is the central axis line 151. The disc portion 205 has a through hole 212 (see FIG. 14) which is circular-shaped and of which center is the central axis line 151. The inner diameter of the through hole 212 is smaller to some extent than the outer diameter of the spout attachment portion 203 of the bag 201.

The insertion portion 206 has a substantially cylindrical shape with the central axis line 151 as the center thereof. The insertion portion 206 is extended in the second direction 156 from a first surface 205A, of the disc portion 205, facing the second direction 156. An end portion, of the insertion portion 206, facing the second direction 156 has a tapered shape of which outer diameter becomes smaller toward the tip end of the insertion portion 206. The inner circumferential surface of the insertion portion 206 is extended along the central axis line 151, and is opened at the tip end, of the insertion portion 206, facing the second direction 156. The inner circumferential surface of the insertion portion 206 forms an ink discharge passage 213. The inner passage 203A of the spout attachment portion 203 of the bag 201 and the ink discharge passage 213 of the spout 204 are an example of the liquid discharge passage.

Each of the three arms 207 is extending in the second direction 156 from the periphery portion in the first surface 205A of the disc portion 205. Each of the three arms 207 has a curved plate-like shape expanding along a circumferential surface with the central axis line 151 as the center thereof. The three arms 207 have a same shape. The three arms 207 are arranged in the circumferential direction at equal intervals therebetween in the circumferential direction with the central axis line 151 along the second direction 156 as the center thereof. Namely, an orthogonal line extending toward the central axis line 151 from the center of a certain arm 207 among the three arms 207 defines an angle of 120 degrees with each of orthogonal lines extending toward the central axis line 151 respectively from the centers of other arms 207 among the three arms 207.

Each of the craws 208 is arranged on an end portion 207A, in the second direction 156, of one of the arms 207. The craw 208 has a substantially flat plate-like shape expanding along a plane orthogonal to the central axis line 151. The craw 208 is extending from each of the arms 207 in a direction approaching toward the central axis line 151, up to a position away from the outer circumferential surface of the insertion portion 206 with a spacing distance (clearance). A surface, in the craw 208, facing the third direction 157, forms an abutting surface 208A. The abutting surface 208A is extending along the plane orthogonal to the central axis line 151. A surface, of the craw 208, in the second direction 156 forms a guide surface 208B which is inclined with respect to the central axis line 151 so as to approach more closely to the abutting surface 208A, as approaching more closely to the central axis line 151. The three craws 208 are arranged inside a virtual surface orthogonal to the second direction 156, at equal intervals therebetween on the circumference of a virtual circle drawn with the central axis line 151 which is along the second direction 156 as the center of the virtual circle.

The release arm 209 is extending in the third direction 157 from a second surface 205B, of the disc portion 205, facing the third direction 157. The release arm 209 has a curved plate-like shape expanding along a circumferential surface with the central axis line 151 as the center thereof. The release arm 209 is located at a position coincident with one arm 209, among the three arms 209, in the circumferential direction and the radial direction of the disc portion 205. In a case that a force approaching toward the central axis line 151 is applied to the release arm 209 by the user, then the disc portion 205 is deformed such that the periphery portion, in the disc portion 205, at which the release arm 209 is arranged, is thereby moved in the third direction 157. As a result, the end portion 207A of the one arm 207 is moved to the outside in the radial direction, which in turn causes the craw 208 to move to the outside of the radial direction, accompanying with the outward movement of the end portion 207A in the radial direction.

The auxiliary arm 210 is extending from the second surface 205B in the third direction 157 of the disc portion 205. The auxiliary arm 210 is located at a position away from the central axis line 151, and is located at a position opposite to (facing) the release arm 209 in a line connecting the central axis line 151 and the center, of the release arm 209, in the circumferential direction, with the central axis line interposed between the auxiliary arm 210 and the release arm 209.

Since operations executed in a case of attaching the ink injection container 214 to the ink tank 100 and in a case of detaching the ink injection container 214 from the ink tank 100 are same as those described in the above-described embodiment, the explanation therefor will be omitted. Note that in the above-described embodiment, the user pinches the release arm 190 and the bag attachment portion 186 by, for example, the thumb and the index finger, and applies the force in such a direction that allows the release arm 190 and the bag attachment portion 186 approach toward each other. In the third modification, the user may pinch the release arm 209 and the auxiliary arm 210 by, for example, the thumb and the index finger, and may apply a force in such a direction that allows the release arm 209 and the auxiliary arm 210 approach toward each other.

Note that the release arm 209 may be arranged between two arms 207, among the three arms 207, in the periphery of the disc portion 205. In such a case that the release arm 209 is arranged in this manner and that an elastic body of which modulus of elasticity is relatively low is used to form the disc portion 205, the disc portion 205 is elastically deformed to a great extent when the release arm 209 is being operated, thereby releasing the contact between the abutting surfaces 208A of the craws 208 of the two arms 209, which are located closely to the release arm 209, and the second connecting surface 177 of the cylindrical wall 121 of the ink tank 100.

Second Embodiment

Figure 17A:
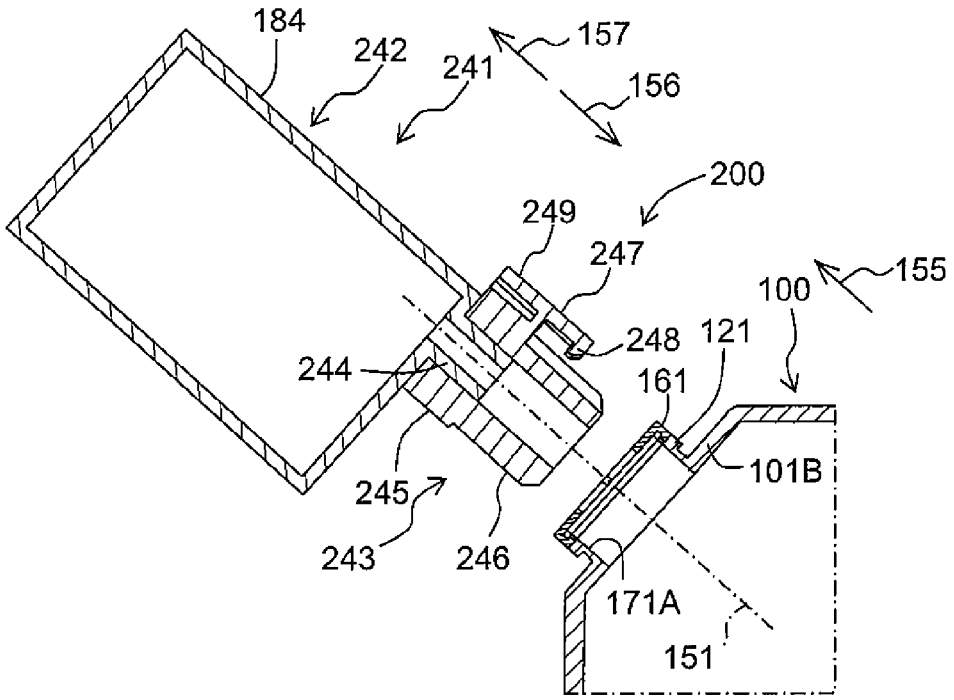
Figure 17B:
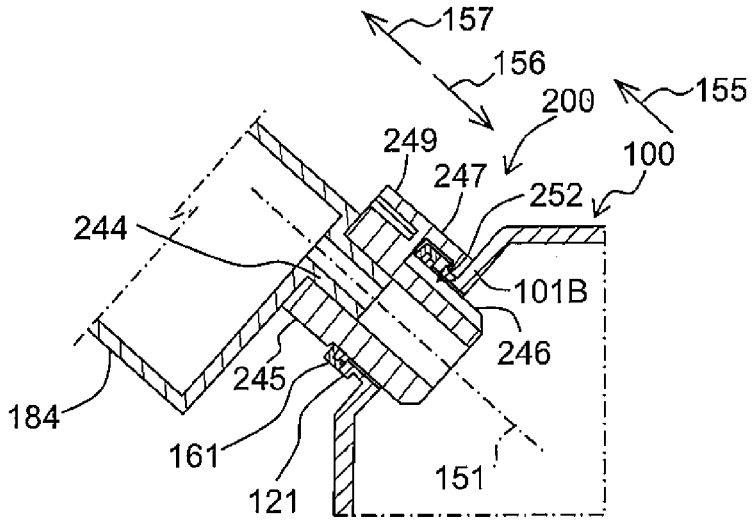
Figure 18:
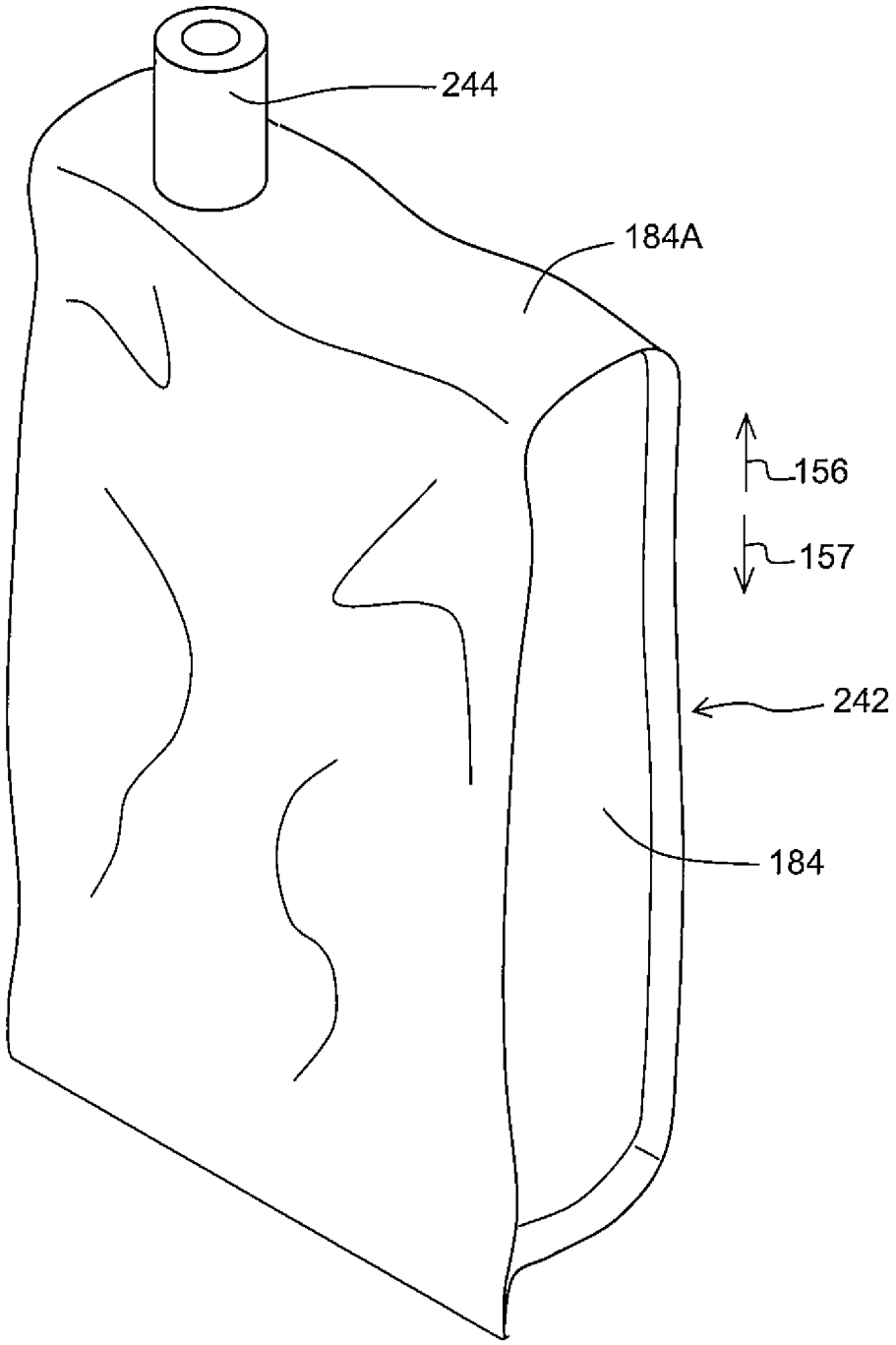
FIG. 18 is a perspective view of a bag 242 in the second embodiment.
Figure 19:
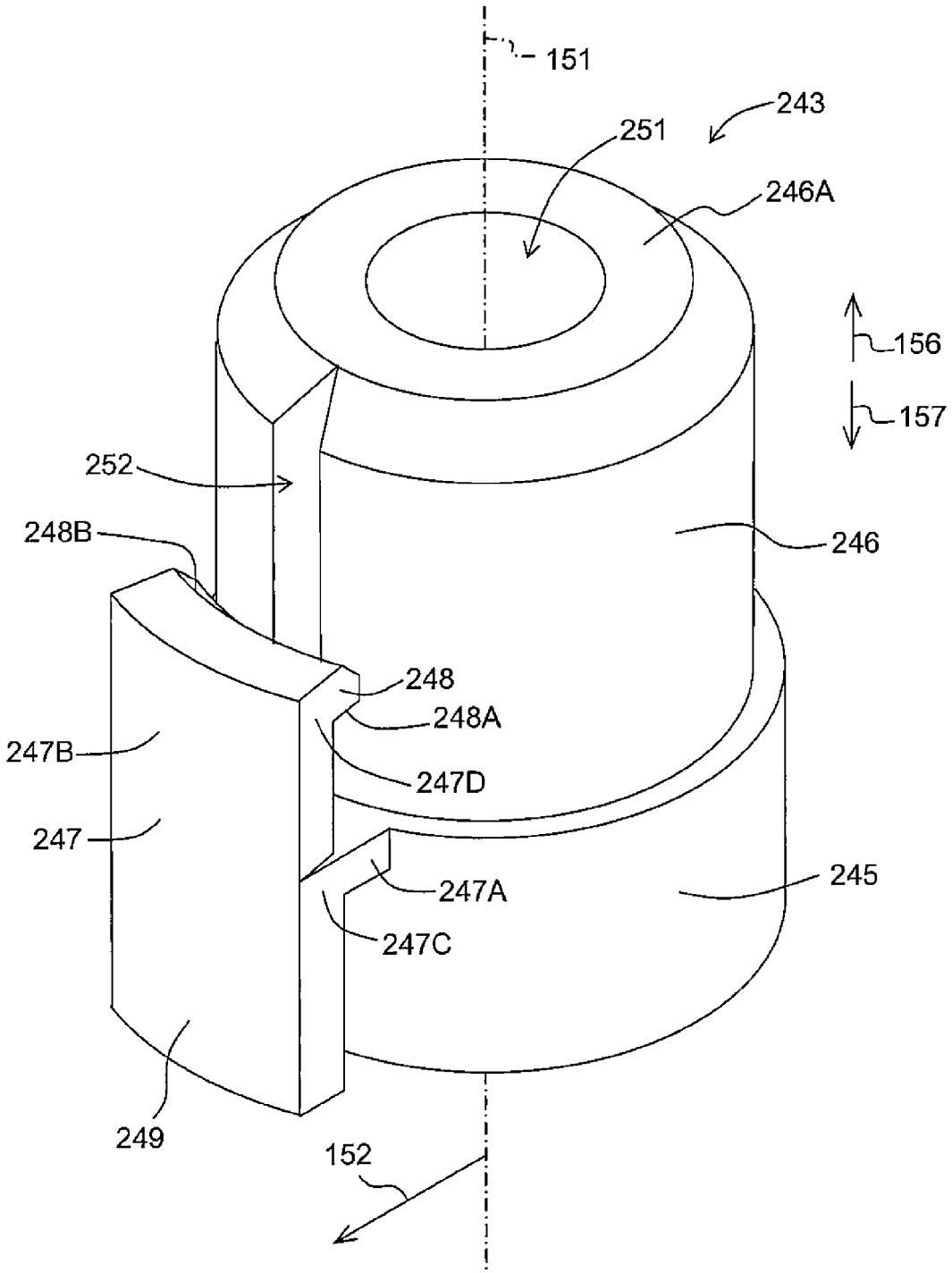
FIG. 19 is a perspective view of a spout 243 in the second embodiment.

It is allowable to use an ink injection container 241 as depicted in FIGS. 17 to 19, rather than using the ink injection container 181 in the above-described embodiment and modifications. The ink injection container 241 is provided with a bag 242 and a spout 243.

As depicted in FIG. 18, the bag 242 is different from the bag 182 depicted in FIG. 10 in the location at which the spout attachment portion 244 is arranged in the bag 242. In the bag 242, the spout attachment portion 242 is projecting from an end portion in the longitudinal direction, of a surface 184A of the ink storing portion 184. Other than the arrangement location of the spout attachment portion 244, the bag 242 is same as the bag 182.

As depicted in FIG. 19, the spout 243 is provided with a bag attachment portion 245, an insertion portion 246, one arm 247, a craw 248 and a release arm 249. The spout 243 is formed, for example, of a synthetic resin such as PE, etc.

The bag attachment portion 245 has a cylindrical shape with the central axis line 151 as the center thereof. The inner diameter of the bag attachment portion 245 is smaller to some extent than the outer diameter of the spout attachment portion 244 of the bag 242. By forcibly inserting (pressing) the spout attachment portion 244 of the bag 242 into the inside of the bag attachment portion 245, the bag attachment portion 245 and the spout attachment portion 244 are fixed to each other, thereby constructing the ink injection container 241 as depicted in FIGS. 17A and 17B.

The insertion portion 246 has a substantially cylindrical shape with the central axis line 151 as the center thereof. The insertion portion 246 is extended in the second direction 156 from an end surface, of the bag attachment portion 245, facing the second direction 156. An end portion 246A, of the insertion portion 246, facing the second direction 156 has a tapered shape of which outer diameter becomes smaller toward the tip end of the insertion portion 246. The inner circumferential surface of the insertion portion 246 is extended along the central axis line 151, and is opened at the tip end, of the insertion portion 246, facing the second direction 156. The inner circumferential surface of the insertion portion 246 forms an ink discharge passage 251. The outer diameter of the insertion portion 246 is substantially same as the inner diameter of the cylindrical wall 121 of the inlet port 112.

The arm 247 is arranged on the outer circumferential surface of an end portion, of the bag attachment portion 245, facing the second direction 156. The arm 247 is constructed of a first arm portion 247A and a second arm portion 247B. The first arm portion 247A has a flat plate-like shape expanding along a plane orthogonal to the central axis line 151. The second arm portion 247B has a curved plate-like shape expanding along a circumferential surface with the central axis line 151 as the center thereof. The first arm portion 247A is extending from the bag attachment portion 245 in the outward direction 152 in the radial direction with the central axis line 151 as the center thereof. The second arm portion 247B is extending in the second direction 156 from an end portion 247C, in the first arm portion 247A, which is away from the bag attachment portion 245.

The craw 248 is arranged on an end portion 247D, in the second direction 156, of the second arm portion 247B of the arm 247. The craw 248 has a substantially flat plate-like shape expanding along a plane orthogonal to the central axis line 151. The craw 248 is extending from the end portion 247D of the arm 247 from the end portion 247D in a direction approaching toward the central axis line 151, up to a position away from the outer circumferential surface of the insertion portion 246 with a spacing distance (clearance). A surface, in the craw 247, facing the third direction 157, forms an abutting surface 248A. The abutting surface 248A is extending along the plane orthogonal to the central axis line 151. A surface, of the craw 248, in the second direction 156 forms a guide surface 248B which is inclined with respect to the central axis line 151 so as to approach more closely to the abutting surface 248A as approaching more closely to the central axis line 151.

The release arm 249 is extending in the third direction 157 from the end portion 247C of the first arm portion 247A. The release arm 249 has a curved plate-like shape expanding along a circumferential surface with the central axis line 151 as the center thereof. In a case that a force approaching toward the central axis line 151 is applied to the release arm 249 by the user, then the first arm portion 247A is curved, thereby moving the end portion 247C of the first arm portion 247A in the third direction 157. As a result, the end portion 247D of the second arm portion 247B is moved to the outside in the radial direction, which in turn causes the craw 248 to move to the outside of the radial direction, accompanying with the outward movement of the end portion 247D in the radial direction.

The spout 243 is provided with an air channel groove 252. The air channel groove 252 is a groove extending in the second direction 156 and formed in a portion, of the outer circumferential surface of the insertion portion 246, facing the arm 247, and recessed in a direction approaching toward the central axis line 151 from the outer circumferential surface.

Since operations executed in a case of attaching the ink injection container 241 to the ink tank 100 and in a case of detaching the ink injection container 241 from the ink tank 100 are sane as those described in the above-described first embodiment, the explanation therefor will be omitted.

In a state that the insertion portion 246 of the ink injection container 241 is inserted into the inlet port 112 of the ink tank 100, at least a portion, in the inner circumferential surface 101B of the cylindrical wall 121 and the inclined wall 171A, on a side at which the arm 247 is positioned faces (is opposite to) the insertion portion 246, with the extending portion 164 of the inner lid 161 sandwiched or held therebetween. In this situation, the inner circumferential surface 171A of the cylindrical wall 121 and the inclined wall 101B abuts against the extending portion 164, and also the extending portion 164 abuts against the outer circumferential surface of the insertion portion 246. With this, the cylindrical wall 121 is held between the craw 248 and the insertion portion 246, and the ink injection container 241 is fixed to the inlet port 112.

The outer diameter of the insertion portion 246 of the spout 243 is substantially same as the inner diameter of the cylindrical wall 121 of the inlet port 112. However, in a state that the ink injection container 241 is fixed to the inlet port 112, an air channel is secured between the insertion portion 246 and the cylindrical wall 121 owing to the presence of the air communication groove 252, thereby allowing the air inflow and outflow.

Note that in a case of attaching the ink injection container 241 to the ink tank 100, it is preferable that the ink injection container 241 is attached to the ink tank 100 in such a state that the air channel groove 252 is facing upward in the spout 243. In a case that the ink injection container 241 is attached to the ink tank 100 in such a state that the air channel groove 252 is facing downward in the spout 243, the ink might accumulate in the air channel groove 252 in some cases. This gives rise to such a possibility that the ink might drip off from the spout 243 when the spout 243 is (being) pulled out from the inlet port 112.

In such a manner, the cylindrical wall 121 of the ink tank 100 is held by the craw 248 of the arm 247 of the ink injection container 241 and by the portion, of the outer circumferential surface of the insertion portion 246 of the ink injection container 241, which faces the arm 247. With this, the liquid injection container 241 is easily fixed to the ink tank 100, and it is possible to suppress any disengaging or separation of the ink injection container 241 with respect to the ink tank 100 while the ink is being supplied to the ink tank 100 or is to be supplied to the ink tank 100.

The embodiments and the modifications thereof as described above are aspects in each of which the present teaching is applied to the ink discharging apparatus such as an ink-jet printer configured to print an image, etc. on a recording paper by discharging the four color inks onto the recording paper. However, the present teaching is also applicable to liquid discharging apparatuses usable for various kinds of applications other than the printing of image, etc. For example, the present teaching is applicable also to a liquid discharging apparatus which forms a conductive pattern on a surface of a substrate by discharging a conductive liquid onto the substrate. Further, the kind (color) of the ink is not limited to the four color inks that are black, cyan, magenta and yellow inks, and the kind (color) of the ink can be changed as appropriate. Furthermore, in the embodiments and the modifications thereof as described above, although the explanation has been given about the ink as an example of the liquid, the present teaching is not restricted to this. Namely, instead of the ink, the liquid may be a pretreatment liquid which is to be discharged onto a recording paper before jetting an ink at the time of printing, or may be water, etc. which is to be sprayed in the vicinity of the nozzles 40 of the recording head 39 for preventing drying of the nozzles 40 of the recording head 39.

What is claimed is:

1. A tank system comprising:

a tank including:

a liquid storage chamber configured to store liquid therein;

an outer wall having an inner surface facing the liquid storage chamber and an outer surface facing outside of the tank;

a cylindrical wall having a cylindrical shape and extending from the outer wall in a first direction;

the tank being formed with an inlet port penetrating through the outer wall and the cylindrical wall in the first direction, and communicating the liquid storage chamber with the outside of the tank; and an outlet port penetrating through the outer wall and communicating the liquid storage chamber with the outside of the tank, the first direction including an upwardly-facing component when the tank is oriented for normal operation so as to supply liquid stored in the liquid chamber through the outlet port;

a liquid injection container including:

a liquid storing portion configured to store the liquid therein;

a liquid discharging portion extending in a second direction, having a liquid discharge passage formed therein, and configured to communicate the liquid storing portion and the liquid storage chamber via the liquid discharging passage in a state that the liquid discharging portion is inserted into the inlet port;

an arm extending from an outer surface of the liquid discharging portion in a direction including a component in the second direction; and a craw extending, from an end portion in the second direction of the arm, in a direction approaching toward the liquid discharging portion, wherein the cylindrical wall includes: a first portion, a second portion located between the first portion and the outer wall and having an outer diameter smaller than that of the first portion, and a connecting surface connecting an outer circumferential surface of the first portion and an outer circumferential surface of the second portion; and the craw is configured to contact the connecting surface of the cylindrical wall in the first direction in the state that the liquid discharging portion is inserted into the inlet port.

2. The tank system according to claim 1, wherein the arm is configured as a plurality of arms, and the craw is provided as a plurality of craws disposed on the plurality of arms, respectively.

3. The tank system according to claim 2, wherein the plurality of craws are disposed in a plane orthogonal to the second direction, while being arranged at equal intervals therebetween on a circumference with a central axis, of the liquid discharging portion, which is along the second direction, as the center of the circumference.

4. The tank system according to claim 2, wherein a number of the plurality of arms and a number of the plurality of craws are each three.

5. The tank system according to claim 1, wherein the arm is provided as a single arm; and a portion, of a portion of an outer circumferential surface of the liquid discharging portion, which faces the single arm contacts an inner circumferential wall of the cylindrical wall in the state that the liquid discharging portion is inserted into the inlet port.

6. The tank system according to claim 1, wherein the liquid injection container has an operation portion configured to be operated so as to elastically deform the arm, to thereby move the end portion, in the second direction, of the arm in a direction separating away from the discharge passage.

7. The tank system according to claim 6, wherein the operation portion includes a release arm extending from the arm in a third direction which is opposite to the second direction.

8. The tank system according to claim 7, wherein the operation portion includes an auxiliary arm extending in the third direction; and the liquid discharging portion is positioned between the release arm and the auxiliary arm.

9. The tank system according to claim 1, wherein the liquid storing portion has a bag-shaped member which is made of a sheet.

10. The tank system according to claim 1, wherein the tank has a cap configured to be detachably installable in the inlet port, the cap including:

a seal portion configured to contact an inner circumferential surface of the cylindrical wall or of the outer wall defining the inlet port, or contact an end surface of the cylindrical wall exposed to the outside of the tank, in a state that the cap is installed in the inlet port; and a plurality of projections provided on the cap while being spaced from each other in a circumferential direction, of the cap, of which center is the first direction, each of the plurality of projections having an abutting surface facing the connecting surface of the cylindrical surface in the first direction, in the state that the cap is installed in the inlet port.

11. The tank system according to claim 1, wherein an end portion, of the cylindrical wall, in the first direction has an elastic portion formed of an elastic body; and the elastic portion has an extending portion extending from a peripheral edge portion of the inlet port in a direction toward a central axis of the cylindrical wall.

12. The tank system according to claim 11, wherein the extending portion includes a cross-shaped cutout portion which is formed in a disc-shaped elastic body configured to close the inlet port, a point of intersection of the cross-shaped cutout portion being the central axis of the inlet port.

13. The tank system according to claim 1, wherein the first direction intersects a vertical direction in the state that the liquid discharging portion is inserted into the inlet port.

14. The tank system according to claim 1, wherein the tank has an atmosphere communicating portion configured to communicate the liquid storage chamber with the outside of the tank, and a semipermeable membrane sealing the atmospheric communication portion; and in the state that the liquid discharging portion is inserted into the inlet port, a gap is defined between the liquid discharging portion and an inner circumferential surface of the cylindrical wall and an inner circumferential surface of the outer wall defining the inlet port.

15. The tank system according to claim 14, wherein the liquid discharging portion has a groove extending in the second direction and formed in a portion, of an outer circumferential surface of the liquid discharging portion, facing the arm; and the gap is defined by the groove.

* * * * *